US007821257B2

(12) United States Patent
Fujita et al.

(10) Patent No.: US 7,821,257 B2
(45) **Date of Patent: *Oct. 26, 2010**

(54) METHOD AND DEVICE FOR FORECASTING/DETECTING POLISHING END POINT AND METHOD AND DEVICE FOR MONITORING REAL-TIME FILM THICKNESS

(75) Inventors: Takashi Fujita, Tokyo (JP); Toshiyuki Yokoyama, Tokyo (JP); Keita Kitade, Tokyo (JP)

(73) Assignee: Tokyo Seimitsu Co., Ltd, Tokyo (JP)

( * ) Notice: Subject to any disclaimer, the term of this patent is extended or adjusted under 35 U.S.C. 154(b) by 48 days.

This patent is subject to a terminal disclaimer.

(21) Appl. No.: 12/228,945

(22) Filed: Aug. 18, 2008

(65) Prior Publication Data

US 2009/0061733 A1 Mar. 5, 2009

(30) Foreign Application Priority Data

Sep. 3, 2007 (JP) ..... 2007-228146
Apr. 23, 2008 (JP) ..... 2008-112165

(51) Int. Cl.
*G01B 7/06* (2006.01)
*B24B 49/04* (2006.01)
*G01R 33/12* (2006.01)
*B24B 49/10* (2006.01)

(52) U.S. Cl. ..... 324/229; 324/239; 451/8

(58) Field of Classification Search ..... 324/222, 324/226, 228, 229, 230, 239; 438/11, 13, 438/14, 17, 18, 692; 451/5, 6, 7, 8, 9, 10, 451/41; 427/9, 10

See application file for complete search history.

(56) References Cited

U.S. PATENT DOCUMENTS

| | | | | |
|---|---|---|---|---|
| 5,559,428 | A | 9/1996 | Li et al. | 324/71.5 |
| 7,046,001 | B2 | 5/2006 | Tada et al. | 324/230 |
| 2002/0047705 | A1 * | 4/2002 | Tada et al. | 324/230 |
| 2006/0214657 | A1 | 9/2006 | Tada et al. | 324/230 |
| 2007/0103150 | A1 | 5/2007 | Tada et al. | 324/229 |
| 2008/0290865 | A1 * | 11/2008 | Fujita et al. | 324/230 |
| 2009/0058409 | A1 * | 3/2009 | Fujita | 324/230 |
| 2009/0256558 | A1 * | 10/2009 | Fujita et al. | 324/230 |

* cited by examiner

*Primary Examiner*—Kenneth J Whittington
(74) *Attorney, Agent, or Firm*—Fattibene and Fattibene; Paul A. Fattibene

(57) ABSTRACT

A method and device for forecasting/detecting a polishing end point and for monitoring a real-time film thickness to suppress Joule heat loss due to the eddy current to the minimum, to precisely forecast/detect a polishing end point, to precisely calculate the remaining film thickness to be removed, and polishing rate. An inductor 36 in a sensor is arranged adjacent to a predetermined conductive film 28, and a magnetic flux change induced in the conductive film 28 by a magnetic flux formed by the inductor 36 is monitored, and by use of a magnetic flux change when a film thickness becomes corresponding to skin depth in which a film thickness in polishing is determined by the material of the predetermined conductive film 28 as a factor, a magnetic flux change part to forecast a polishing end point in the magnetic flux change process is detected, and a polishing end point is forecasted from the magnetic flux change part, and a polishing rate and a remaining film thickness amount to be removed are calculated on the spot.

14 Claims, 15 Drawing Sheets

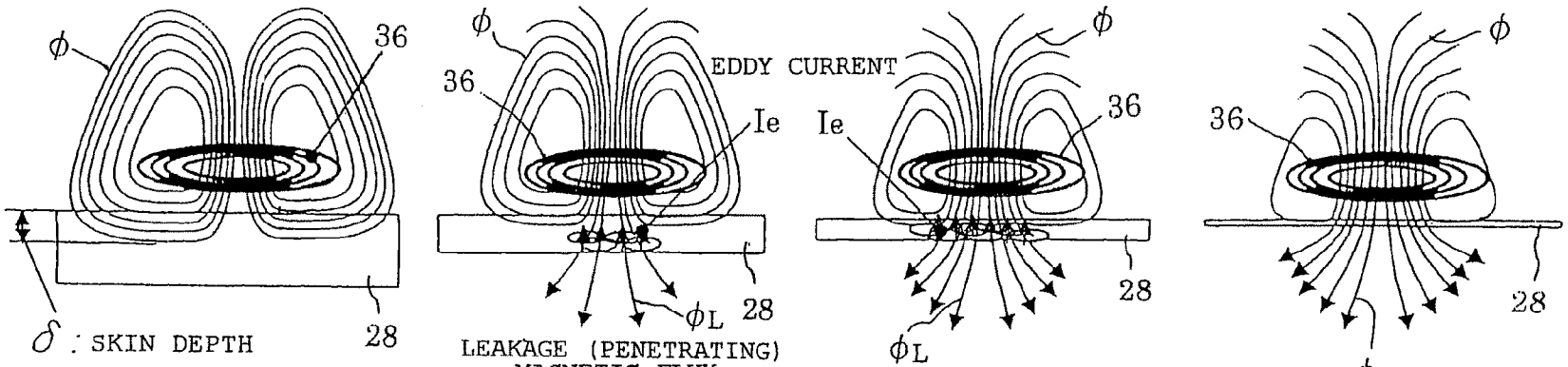
FIG.9(a)
FIG.9(b)
FIG.9(c)
FIG.9(d)
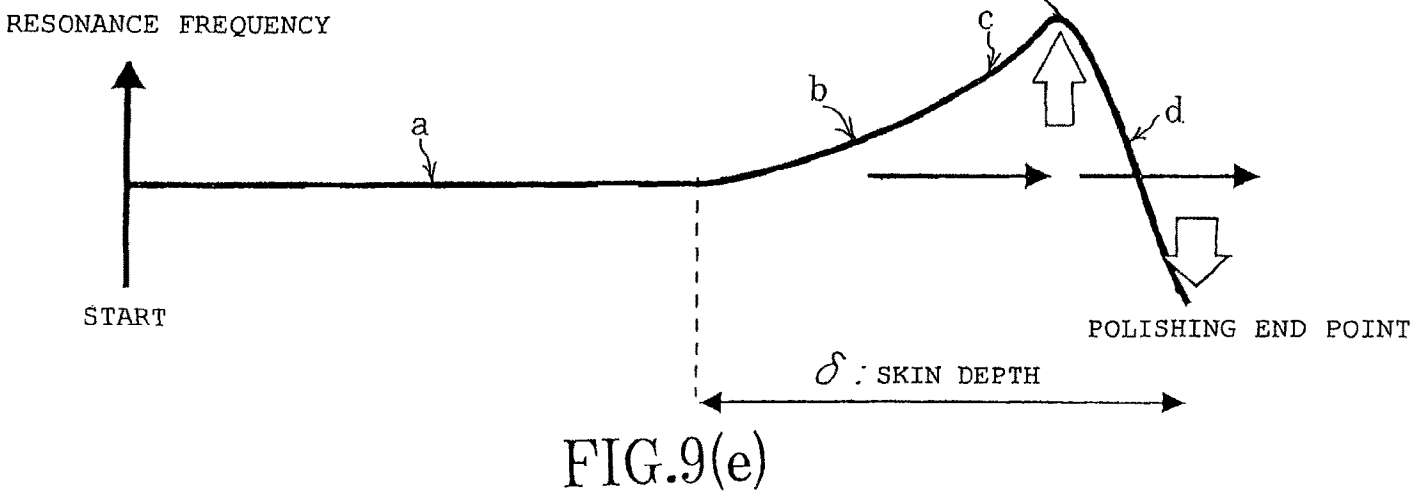
FIG.9(e)

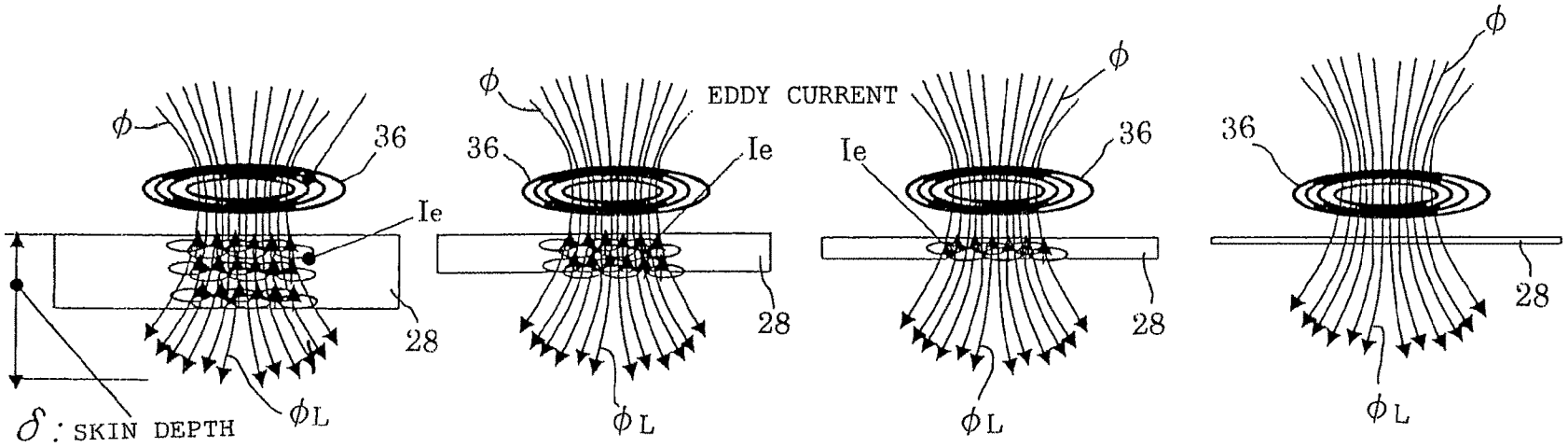
FIG.10(a)
FIG.10(b)
FIG.10(c)
FIG.10(d)
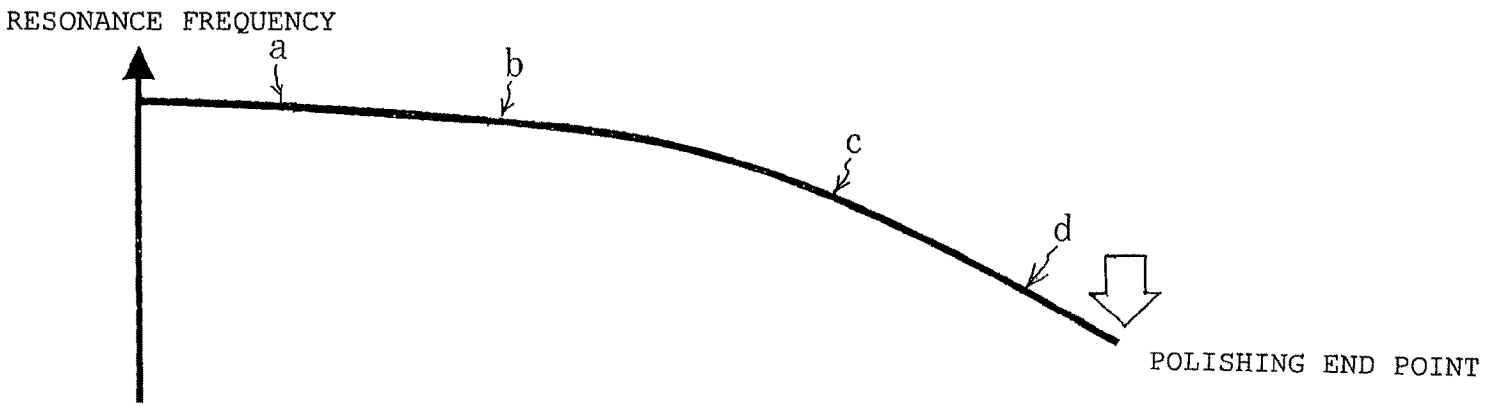
FIG.10(e)

CORRESPONDENCE BETWEEN THE FILM THICKNESS CHANGE AND THE RESONANCE FREQUENCY

CORRESPONDENCE BETWEEN THE FILM THICKNESS CHANGE AND THE PRIMARY DIFFERENTIAL CALCULUS VALUE OF THE RESONANCE FREQUENCY

CORRESPONDENCE BETWEEN THE FILM THICKNESS CHANGE AND THE SECONDARY DIFFERENTIAL CALCULUS VALUE OF THE RESONANCE FREQUENCY

METHOD AND DEVICE FOR FORECASTING/DETECTING POLISHING END POINT AND METHOD AND DEVICE FOR MONITORING REAL-TIME FILM THICKNESS

BACKGROUND OF THE INVENTION

1. Field of the Invention

The present invention relates to a method and device for forecasting/detecting a polishing end point and a method and device for monitoring a real-time film thickness, in particular, it relates to a method and device for forecasting/detecting a polishing end point and a method and device for monitoring a real-time film thickness, for precisely forecasting/detecting a polishing end point, while suppressing Joule heat loss due to an eddy current in a chemical mechanical polishing (CMP) at the minimum, and precisely evaluating in real-time whether a predetermined conductive film has been appropriately removed.

2. Description of the Related Art

There has been know a process is known in which, for example, an oxide film is formed on a surface of a semiconductor wafer, and lithography and etching are performed on the oxide firm and a groove pattern corresponding to a wiring pattern is formed, and a conductive film that is made of Cu and the like to fill up the groove pattern is formed thereon, and other unnecessary portion other than the filled up portion such as the groove pattern or a through hall part and the like of the conductive film are removed by the chemical mechanical polishing, thereby forming a wiring pattern. In this wiring pattern formation, it is extremely important to precisely detect the polishing end point at the moment when the conductive film of the unnecessary parts is removed at appropriate thickness and stop the process. If the polishing of the conductive film is excessive, the resistance of the wiring increases; meanwhile, if the polishing is insufficient, insulation failures of the wiring occur.

As a conventional technology related to this, for example, the following monitor method on the spot of a change of film thickness is known. This conventional technology is a method to monitor the thickness change of the conductive film in a method to remove a conductive film by chemical mechanical polishing from a substrate main body (semiconductor wafer) on the spot, and a sensor including a serial or parallel resonance circuit of an inductor consisting of a coil wound around a ferrite pot type core for shaping an electromagnetic field so as to have directivity to the same and a capacitor is arranged at the vicinity of the conductive film, and a sweep output consisting of a frequency of 20 Hz to 40.1 MHz from an excitation signal source is applied to the sensor through impedance means for movement point setting. Thereby, when the sensor is excited, an oscillation electric current flows into the coil and, an alternating electromagnetic field occurs. Subsequently, this alternating electromagnetic field guides an eddy current into the conductive film. When the eddy current is guided to the conductive film, two effects occur. Firstly, the conductive film acts as loss resistance, and the effect is a resistance load to the sensor circuit, and this lowers the amplitude of the resonance signal, and lowers the resonance frequency. Secondly, when the thickness of the conductive film decreases, an effect in which a metal rod is pulled out from the coil of the inductor occurs, and causes a change of the inductance and a frequency shift. By monitoring the change of the frequency shift related to the sensor resonance peak due to the thickness change of the conductive film in this manner, the thickness change of the conductive film is continually detected (for example, see Patent Document 1).

Further, as another conventional technology, for example, the following eddy current sensor is known. This conventional technology is equipped with a sensor coil (an eddy current sensor) arranged at the vicinity of a conductive film or a substrate on which a conductive film is formed, an alternate current signal source that supplies an alternate current signal of a constant frequency around 8 to 32 MHz to the sensor coil and forms an eddy current in the conductive film, and a detection circuit that measures reactance components and resistance components including the conductive film, and the sensor coil is equipped with an oscillation coil connected to the signal source, a detection coil arranged at the conductive film side of the coil, and a balance coil arranged at the opposite to the conductive film side of the oscillation coil, and the detection coil and the balance coil are connected so as to mutually reverse phase. Then, synthetic impedance is output from the resistance components and the reactance components detected by the detection circuit, and the changes of the film thickness of the conductive film are detected as approximately linear relations in a wide range from the changes of the impedance. (For example, see Patent Document 2.)

Furthermore, as still another conventional technology, for example, the following eddy current sensor is known. In this conventional technology too, in the same manner as in the conventional technology shown above, in [0008], it is described that the magnetic flux that a sensor coil forms penetrates a conductive film on a substrate arranged on the entire surface of the sensor coil, and changes alternately and causes an eddy current in the conductive film, and the eddy current loss occurs because the eddy current flows into the conductive film, and decreases reactance components of the impedance of the sensor coil when viewed as an equivalent circuit. Further, in [0009], it is described that by observing changes of the oscillation frequency of the oscillation circuit, when a conductive film gradually becomes thin, with the progress of polishing, the oscillation frequency decreases by this, and becomes the self oscillation frequency of the tank circuit where the conductive film completely disappears by polishing, and after that, the oscillation frequency becomes roughly constant. Therefore, by detecting this point, the end point of the chemical mechanical polishing of the conductive film can be detected. Furthermore, in [0025], it is described that as shown in FIG. 2, the eddy current loss changes when the polishing of the conductive film progresses, and the equivalent resistance value of the sensor coil changes. Therefore, the oscillation frequency of the oscillation circuit changes, and by dividing this oscillation signal by a frequency dividing circuit, or subtracting the same by a substractor, a signal corresponding to the size of the frequency of the detection width is displayed on a monitor. Thereby, a transition of frequency locus as shown in FIG. 2 mentioned above is obtained (for example, see Patent Document 3).

[Patent Document 1] Japanese Patent Application Publication No. 2878178 (pages 2 to 7, FIGS. 1 to 15)

[Patent Document 2] Japanese Patent Application Publication No.3587822 (page 3, FIGS. 1 to 11).

[Patent Document 3] Japanese Patent Application Laid-Open No.2003-21501

In the conventional technology described in the Patent Document 1, a serial or parallel resonance circuit of an inductor consisting of a coil wound around a ferrite pot type core for shaping an electromagnetic field so as to have directivity to the same and a capacitor is arranged. Then, a sweep output consisting of a frequency of 20 Hz to 40.1 MHz is applied to the sensor at the early stage of polishing, and by an alternating electromagnetic field having the directivity occurred from the coil, a leakage magnetic flux that penetrates the conductive film is generated and a large eddy current corresponding to the film thickness of the conductive film is guided from the early stage of polishing. In order to guide a large eddy current corresponding to the film thickness of the conductive film, it is necessary to form a large alternate current electromagnetic field, that is, a large magnetic flux of such a degree as to penetrate the conductive film, and the monitor of the thickness changes of the conductive film is carried out by use of the eddy current guided into the conductive film from the early stage of polishing to the end stage of polishing. Therefore, during the monitor of the film thickness changes, it is necessary to make the magnetic flux penetrate toward the thickness direction of the conductive film. The above is clear from the fact that a magnetic flux line penetrating the conductive film is described in the part of all conductive films, in the drawings of the bulletin concerning the Patent Document 1.

On the surface of the wafer in the early stage of polishing, it is common that there is a pure Cu film (a conductive film) at the top layer. A very large leakage magnetic flux is necessary to guide an eddy current to all of these pure Cu films. However, the leakage magnetic flux induces eddy currents, but they are consumed as a Joule heat in form of the eddy current loss soon. Because this Joule heat loss has a small volume resistance to the pure Cu film at the most outer layer, the heat generation is comparatively small, but in the inside part which is already wired, because a wiring cross sectional area is small and its volume resistance is small, a large eddy current is induced by penetrating magnetic flux, and as a result, a large Joule heat loss is locally produced. This occasionally causes a problem that the wiring is partially molten and disconnected. It becomes a condition of so-called induction heating, and particularly become the phenomenon that the inside is full of heat. In particular, in a Cu wire and the like, when Cu is heated, Cu may diffuses into barrier films of Ta and the like, and in some cases, Cu breaks through barrier films and diffuses.

Further, when several layers of wires are arranged in the surface section of the wafer, furthermore to the fear of the Cu film of the surface layer, the internal wiring part whose processing has already been completed is warmed partially and spreads to circumference, and dopant forming p type, n type in the semiconductor substrate diffuses more, and there is a possibility that the characteristics of the element in the substrate are changed. Furthermore, even when heat does not occur, if an excessive eddy current flows in minute wires, there is a possibility that electromigration is induced and wires may be disconnected.

Furthermore, for example, at the moment of a predetermined remaining film amount near the polishing end point, when a process is made by changing polishing conditions, it is difficult to ascertain whether it is a predetermined remaining film amount or not. Changes from an initial film thickness can be guessed, but when the initial film thickness varies, the estimate of predetermined remaining film amount varies. As for the judgment on this polishing end point, when a gap between the sensor and the conductive film finely changes by vibration of the polishing, the floating capacity of the whole sensor circuit system changes, and the whole resonance frequency shifts. Therefore, the judgment on a polishing end point by the setting of the threshold value becomes difficult if a resonance frequency totally shifts even if the threshold value is set at the moment of a resonance frequency of a certain setting so as to make a setting to determine the polishing end point. Thus, in the conventional method, even if the threshold value is set to a certain value, in resonance frequency that increases or decreases monotonously and continuously, when the gap between the sensor and the conductive film changes finely, or there is something dielectric between them, the waveform itself moves upward and downward entirely, as a result, the preset threshold value set beforehand does not have any meaning frequently.

In the conventional technology described in the Patent Document 2 using an eddy current sensor too, the monitor of the film thickness changes of the conductive film is made by the changes of the eddy current from the early polishing stage to the end polishing stage, which is almost same as the conventional technology described in the Patent Document 1.

Further, in the conventional technology to monitor the film thickness of the conductive film by use of eddy currents from the early polishing stage to the end polishing stage, it is necessary to make a magnetic flux strong enough to penetrate into the film in order to induce eddy currents in the film, and as for the shape of the inductor, it is of a three-dimensional shape to be able to give directivity to the magnetic flux. Therefore, there is generally the following problem when to incorporate a sensor in a polishing device. An electric current that flows in the coil becomes large, and electricity consumption increases, and the power supply unit becomes large. Magnetic flux leaks out to the outskirts, and a noise is easy to occur. Processes to surround conducting wire in the shape of a coil are required and increase costs.

In the conventional technology consisting of the eddy current sensor described in the Patent Document 3, at first, as for hardware of this sensor part used in this conventional technology, at first, it is a structure assuming the sensor coil penetrating a conductive film. Therefore, in hardware where only a magnetic field of the degree that does not penetrate a conductive film occurs, eddy currents cannot be formed and the purpose cannot be achieved. Further, because the conductive film is decreased by polishing, the region where an eddy current is formed decreases monotonously, and therefore the oscillation frequency decreases monotonously, and the moment when the oscillation frequency becomes roughly constant is considered as the end point and this point is detected. In the algorithm of this software to use in this conventional technology, as a change of the oscillation frequency, the change from decrease to rough uniformity is made the change of the oscillation frequency, and, for example, in the case when this oscillation frequency has an inflection point, the algorithm cannot be detected. Furthermore, magnetic flux penetrates a conductive film from the early stage of the polishing, and an eddy current is in regular condition to occur as shown in FIG. 2. Herein, the eddy current sensor generates an eddy current positively from beginning to end, and generally speaking, an eddy current sensor has a method of recalculating a film thickness change from the eddy current change.

Therefore, there are technological problem to be solved for precisely forecasting/detecting a polishing end point, and precisely calculating the remaining film amount to be removed and the polishing rate and the like, and precisely evaluating whether a predetermined conductive film has been appropriately removed, without giving strong magnetic flux to minute wires formed in a film, as a result, restraining the occurrence of an eddy current induced by magnetic induction, and suppressing Joule heat loss due to the eddy current at the minimum, and eliminating the situation in which the quantity of eddy current induced shifts entirely, due to the changes of the gap between the sensor and the conductive film and the intervening normal state of the dielectric substances such as slurry and the like, and the setting of the threshold value largely changes and detection becomes hard, and thereby it is possible to sufficiently precisely detect even a minute magnetic field of the degree that does not penetrate the device wafer, and the present invention is aimed at solving these problems.

SUMMARY OF THE INVENTION

The present invention has been suggested to achieve the object, and the invention according to an embodiment provides a polishing end point forecast/detection method for precisely forecasting/detecting a polishing end point at the moment when a conductive film is polished and a predetermined conductive film is appropriately removed, wherein an inductor in a high frequency inductor type sensor is arranged adjacent to the predetermined conductive film, and a magnetic flux change induced in the predetermined conductive film by a magnetic flux formed of the inductor is monitored, and by use of a magnetic flux change that occurs conspicuously by the skin effect in which a film thickness in polishing is determined by the material of the predetermined conductive film as a factor, a magnetic flux change part to forecast a polishing end point in the magnetic flux change process is detected, and an polishing end point is forecasted from the magnetic flux change part.

According to this structure, the inductor is driven at a high frequency, and a magnetic flux that changes in correspondence to the frequency of the high frequency occurs from the inductor. Until a predetermined conductive film reaches a film thickness corresponding to the skin depth by polishing, the magnetic flux induced by the predetermined conductive film passes a region of the skin depth almost in parallel with the film side. When the polishing progresses, and the predetermined conductive film becomes a film thickness same as or near the skin depth, a leakage magnetic flux to penetrate the predetermined conductive film begins to occur. The quantity of eddy current induced in the predetermined conductive film by the change of this magnetic flux by electromagnetic induction changes. An eddy current induced slowly increases the eddy currents so that leakage magnetic flux to penetrate a film increases as the film thickness decreases. By the eddy current that occurs in this large region, a big mutual inductance occurs in the predetermined conductive film. This mutual inductance acts to decrease a self inductance of sensor circuit in the high frequency inductor type sensor. Even if the conductive film thickness decreases in this manner in the early stage, as for the case where the degree of the magnetic flux supplied into the conductive film thickness does not penetrate the wafer, a constant eddy current is formed. Thereafter, when the film thickness decreases more and becomes less than the film thickness corresponding to the skin depth, part of magnetic flux penetrates the conductive film on the wafer, and a magnetic flux that leaks on the back side of the wafer occurs. The eddy current induced in a film becomes large with the increase of the leakage magnetic flux. Next, the eddy current formed on the wafer surface increases to a certain constant film thickness, but the eddy currents decrease afterwards as the conductive film oneself which occurs by an eddy current decreases as a conductive film is removed more. As a result, although it is a monotonous film thickness decrease process, the eddy currents increase with an increase in penetration magnetic flux once, and the maximum point appears in the mutual inductance corresponding to an induced eddy current because the volume in itself to produce an eddy current decreases rapidly with the decrease of the further film thickness. The mutual inductances decrease by the rapid decrease of this eddy current rapidly, and the inductance of sensor circuit system turns for increase. Thus, after the predetermined conductive film becomes a film thickness same as or near the skin depth, an eddy current occurs, and inductance of the sensor circuit system decreases by rapid decrease after that, and then increases by progress of polishing afterwards in this manner. By this behavior, in the waveform of a resonance frequency oscillated by the high frequency inductor type sensor, the waveform change appears by the skin effect conspicuously. And, a waveform change part to forecast a polishing end point during this waveform change process is detected, and a polishing end point is forecasted by the waveform change part.

Since a peak appears at the position corresponding to the consistently remaining film thickness to appear at a film thickness corresponding to the skin depth, there is not the problem that setting of the threshold value by quantity of induced eddy current shifting generally changes. In particular, for example, when a conductive film is Cu, the peak appears at the vicinity of a remainder film of the Cu of 710 Å. Further, in the case of a W film, a peak appears at 2500 Å where remainder film of W is a little thicker. This film thickness is different from the real skin depth, but becomes the numerical value corresponding to the skin depth. Skin depth $\delta$ is the index conveniently showing the depth at which the strength of the electromagnetic wave becomes the size of 1/e, but this peak position is brought by skin effect because it is determined by the conductivity of materials, magnetic permeability, frequency to be applied and the like. The present invention is a technology achieved skillfully by use of a peculiar phenomenon to appear by the skin effect of these materials. As for the wiring materials in CMP of wiring materials, in the sake having the high conductivity, the peak position appears in particular as a sharp peak (maximum point) in the vicinity of end point (710 Å). Therefore, it is possible to perform a robust end point detection/end point forecast, without fluctuation due to various external disturbances.

Furthermore, the inductor type sensor is not a thing that causes an eddy current in a film positively intentionally, and monitors a film thickness. In the conventional well-known sensor, a sensor coil is formed to be able to keep directivity to give a magnetic field to penetrate a conductive film, but, the inductor type sensor in the present invention uses a planar inductor. Thereby, without give the magnetic field directivity, and, for a conductive film, it is an inductor aimed at diffusing magnetic field moderately, not to penetrate deeply into a conductive film. This is because wiring itself is disconnected by electromigration and the like, by being overheated partially, when the magnetic field penetrates deeply, or a magnetic field that is strong is given to penetrate a magnetic field deeply. Therefore, in other words, it is the structure of a planar inductor forming moderate magnetic flux distribution of the degree that does not generate the eddy current that gives element damage without letting a magnetic field penetrating into a conductive film as much as possible. Further, magnetic flux to penetrate a conductive film appears in the part even if a magnetic field that diffuses moderately, when a conductive film becomes thin at the interval at which a conductive film is removed. A sudden change to appear at the thin conductive film state in the vicinity of this end point is monitored. Therefore, the algorithm to detect frequency, an inductor and the signal thereof has a structure to maximize an inflection point in the vicinity of end point.

The invention according to an embodiment provides a polishing end point forecast/detection method wherein the method to detect a change part of the magnetic flux by the skin effect detects the changes peculiar to the skin effect of the top of the peak, an inflection point, the rate of climb of the change, quantity of rise change, and a change of rise starting point.

According to this structure, the magnetic flux change part by the skin effect is carried out by detecting the changes peculiar to the skin effect of the top of the peak, an inflection point, the rate of climb of the change, quantity of rise change, and rise starting point.

The invention according to an embodiment provides a polishing end point forecast/detection method wherein the method to detect a magnetic flux change part by the skin effect detects the characteristic changes peculiar to the skin effect of a waveform peak point, an inflection point, predetermined rate of climb point and the like.

According to this structure, the magnetic flux change part by the skin effect is carried out by detecting the characteristic changes peculiar to the skin effect of a waveform peak point, an inflection point, and predetermined rate of climb point.

The invention according to an embodiment provides a polishing end point forecast/detection method wherein a high frequency inductor type sensor adjacent to the conductive film is a two-dimensional planar inductor.

According to this structure, in the conventional inductor formed into a three-dimensional manner, directivity for magnetic flux to invade to a conductive film in the vertical direction is improved and magnetic flux got into the inside of device wafer, and there was the case that wire inside the device was disconnected by electromigration. In contrast, according to the method with this two-dimensional planar inductor, magnetic flux does not positively invade to the inside of the conductive film because magnetic flux for the conductive film diffuses moderately and does not have directivity. Furthermore, it is possible to prevent disconnection by the Joule heat by the eddy current occurrence inside the device wafer and electromigration by an excessive electric current due to impossibility to invade to the conductive film inside in magnetic flux by skin effect more when frequency to be given is made larger than 30 MHz. Further, part of the magnetic flux penetrates a conductive film to form an eddy current when the surface conductive film is decreased to that just being removed. At the film thickness at the vicinity of end point, the change of the waveform corresponding to an extremely remarkable mutual inductance is generated, therefore, it is possible to detect the end point of the polishing.

The invention according to an embodiment provides a polishing end point forecast/detection method wherein the high frequency inductor type sensor adjacent to the conductive film is of a structure in which a conductive film is attached onto the surface of a substrate formed of an insulator.

According to this structure, it is possible to produce a sensor in easy and low cost manner, by deposing or applying a conductive substance such as Cu on an insulation substrate including glass/epoxy such as a printed substrate and paper/phenol. Furthermore, in comparison with the method using a winding, it is possible to produce the sensor with line width extremely finely by etching after application of a conductive film, and miniaturize the sensor size itself. By the miniaturization of the sensor, it is possible to generate a further fine magnetic field efficiently, and it is possible to precisely detect change behaviors in the vicinity of end point of film removal without penetrating the magnetic field deeply into the inside of the conductive substance. Further, by the miniaturization of the sensor, it is possible to dispose a great number of sensors in correspondence to the position in wafer face, and thereby it is possible to precisely detect the uniformity of the polishing in the wafer face.

The invention according to an embodiment provides a polishing end point forecast/detection method wherein the monitor of the magnetic flux change that is induced on the basis of the skin effect of the predetermined conductive film is at least any one of the measurement of the eddy current in the predetermined conductive film, the measurement of the mutual inductance which occurs because the predetermined conductive film generates an eddy current, the measurement of the inductance change of the sensor circuit system in the high frequency inductor type sensor by the mutual inductance of the predetermined conductive film, and the measurement of changes in resonance frequency that the high frequency inductor type sensor oscillates inductance change of the sensor circuit system.

According to this structure, the monitor of the magnetic flux change that is induced on the basis of the skin effect of the predetermined conductive film measures at least any one of the eddy current along with the magnetic flux change, mutual inductance, inductance of the sensor circuit system or resonance frequency that a high frequency inductor type sensor oscillates, and thereby the waveform change part before the polishing end point at which the magnetic flux to penetrate through the predetermined conductive film by the progress of polishing increases is detected definitely.

The invention according to an embodiment provides a polishing end point forecast/detection method wherein an oscillator to oscillate the high frequency inductor type sensor and a frequency counter to monitor a change of the oscillation (resonance) frequency are arranged adjacent to the high frequency inductor type sensor.

According to this structure, it is possible to precisely detect the changes of the magnetic flux in the vicinity of an inductor type sensor, for example, by not detecting a change by the capacitance predominantly, while forming a distributed constant circuit in conventional wiring/line part and preventing the inductance and the capacitance of the circuit from becoming unnecessarily large. Preferably, the oscillator and the frequency counter are arranged in the same package as an inductor type sensor. Furthermore, in several ten MHz range, a distributed constant circuit is formed, and capacitive coupling occurs between a process and a sample rather than the change of the magnetic flux, and a function as the electrostatic combination sensor becomes dominant. However, according to this structure, a region of electrostatic combination is limited because a frequency monitor is arranged in the neighborhood even if the frequency is in several ten MHz range. Therefore, even if in several ten MHz band, rather than a distributed constant circuit, the capacitance and the inductance comparatively function as a constant concentration circuit, and by the magnetic flux that an inductor gives to conductivity materials, it is possible to precisely detect the change of the mutual inductance which conductivity materials working as the reaction give to an inductor.

The invention according to an embodiment provides a polishing end point forecast/detection method wherein the magnetic flux change is induced on the basis of the skin effect of the predetermined conductive film, the change of the eddy current, and the change of the mutual inductance and the change of the resonance frequency include two changes that eddy current is increased by the increase of penetration magnetic flux with film thickness decrease and that eddy current formation region substantially decreases with the sequent film thickness decrease.

According to this structure, when the film thickness of the predetermined conductive film is decreased to less than that corresponding to the skin depth by progress of the polishing, an eddy current and the mutual inductance increase respectively with the increase of the penetration magnetic flux, and the inductance of the sensor circuit system decreases with the increase of this mutual inductance, and the resonance frequencies increase. Eddy current formation regions substantially decrease with the decrease of the film thickness by the progress of the further polishing, and an eddy current and the mutual inductances rapidly decrease, respectively. Then the inductance of the sensor circuit system rapidly increases again, and resonance frequencies rapidly decrease afterwards. By these behaviors, after the predetermined conductive film becomes the film thickness corresponding to the skin depth, a remarkable change part appears in the waveform of an eddy current, and waveforms of the mutual inductance and the resonance frequency. Using the change of such a waveform, a waveform change part to forecast a polishing end point is detected during the waveform change process.

The invention according to an embodiment provides a polishing end point forecast/detection method for precisely forecasting and detecting a polishing end point at the moment when a predetermined conductive film is appropriately removed, wherein an inductor in the high frequency inductor type sensor is arranged adjacent to the predetermined conductive film, and the inductor shape and the frequency band by which a mutual inductance induced on a conductive film by an increase in magnetic flux to penetrate the conductive film of the polishing target with a decrease in film thickness by the polishing process are selected, and a magnetic flux change induced on the predetermined conductive film by magnetic flux formed of the inductor is monitored, and the magnetic flux change in which a film thickness in polishing conspicuously appears by skin effect is used, and a magnetic flux change part to forecast an polishing end point during the magnetic flux change process is detected, and a polishing end point is forecasted from the magnetic flux change part.

According to this structure, the skin depth in the predetermined conductive film is determined by depending on the quality of materials of the predetermined conductive film and the oscillation frequency of the high frequency inductor type sensor. The oscillation frequency is selected so that the skin depth becomes smaller than the initial film thickness of the predetermined conductive film, and becomes larger than the film thickness of the predetermined conductive film in the polishing end stage, and the inductor shape is made so that the penetration magnetic flux increases with film thickness decrease, and the magnetic flux induced at the early polishing stage by the predetermined conductive film passes a region of the skin depth along a film side approximately in parallel, and when the predetermined conductive film becomes lower than film thickness corresponding to the skin depth by progress of the polishing, a penetration magnetic flux to penetrate the conductive film of the polishing target occurs, and an eddy current and mutual inductances increase with the increase of the said penetration magnetic flux. The eddy current formation region substantially decreases with the decrease in the film thickness by the progress of the further polishing, and an eddy current and the mutual inductance rapidly decreases. The magnetic flux change part to forecast a polishing end point is detected after the predetermined conductive film becomes the film thickness corresponding to the skin depth by these behaviors.

The invention according to an embodiment provides a polishing end point forecast/detection method wherein the frequency band to be selected is 20 MHz or more in the case when the quality of material of the predetermined conductive film is Cu.

According to this structure, the frequency band oscillated from the high frequency inductor type sensor is set at 20 MHz or more in the case when the material of the predetermined conductive film is Cu, thereby, the skin depth set in the same order as the initial film thickness of the predetermined conductive film, and smaller than the initial film thickness of the predetermined conductive film and larger than the film thickness of the predetermined conductive film in the polishing end stage.

The invention according to an embodiment provides a polishing end point forecast/detection method for forecasting/detecting a polishing end point at the moment when a conductive film is polished and a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film, and there is at least once of the process in which at least the part of magnetic flux to penetrate the conductive film increases with the progress of polishing, and the change of the leakage magnetic flux to penetrate the predetermined conductive film during the progress of polishing among magnetic flux formed of the inductor is monitored, and by use of the change of the leakage magnetic flux in which a film thickness in polishing conspicuously appears by the skin effect, a leakage magnetic flux change part to forecast a polishing end point in the leakage magnetic flux change process is detected, thereby a polishing end point is forecasted by the leakage magnetic flux change part.

According to this structure, the frequency oscillated from the high frequency inductor type sensor so that the skin effect in which leakage magnetic flux to penetrate the predetermined conductive film begins to occur is set with progress of the polishing without magnetic flux formed of an inductor penetrating the predetermined conductive film almost in early stage of polishing. And after the predetermined conductive film becomes a film thickness corresponding to the skin depth by progress of the polishing, a leakage magnetic flux change to appear conspicuously is used, a leakage magnetic flux change part to forecast an polishing end point in the whole leakage magnetic flu x change process is detected by the skin effect, and an polishing end point is forecasted by the leakage magnetic flux change part.

The invention according to an embodiment provides a polishing end point forecast/detection method for forecasting/detecting a polishing end point at the moment when a conductive film is polished and a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the conductive film by an inductor shape to generate a magnetic field without directivity of the degree that does not penetrate the predetermined conductive film by the skin effect of the predetermined conductive film and the skin effect, and there is at least once of the process in which at least the part of magnetic flux to penetrate the predetermined conductive film increases with the progress of polishing, and the change of leakage magnetic to penetrate the predetermined conductive film during the progress of polishing among magnetic flux formed of the inductor is monitored as the change of a eddy current generated by the leakage magnetic flux, a change part of an eddy current to forecast a polishing end point in the eddy current change process in which the film thickness in polishing conspicuously appears by the skin effect is detected, and a polishing end point is forecasted from the change part of the eddy current.

According to this structure, the frequency oscillated by a high frequency inductor type sensor is set in the same manner as the action of the invention according to another embodiment, and further, from an inductor, a magnetic field without the directivity with the degree that does not penetrate the predetermined conductive film by the skin effect of the predetermined conductive film by the shape occurs in the early polishing stage. Then, the change of the leakage magnetic flux occurring with a progress of the polishing is monitored as a change of the eddy current, and an eddy current change part for forecasting a polishing end point during the change process of the eddy current in which the predetermined conductive film conspicuously appears by skin effect by progress of the polishing is detected, and an polishing end point is forecasted by the eddy current change part.

The invention according to an embodiment provides a polishing end point forecast/detection method for precisely forecasting/detecting a polishing end point wherein, in a method to forecast a polishing end point from a waveform change part by the skin effect, after polishing for a polishing time set beforehand from the waveform change part, the polishing is ended.

According to this structure, the waveform change part for forecasting a polishing end point during the waveform change process conspicuously appearing is detected by the skin effect, and from the polishing rate to be carried out after the detection, it is possible to set required polishing time after the waveform change part detection beforehand. Therefore, after the waveform change part is detected, polishing is finished by polishing for the polishing time set beforehand.

The invention according to an embodiment provides a polishing end point forecast/detection method wherein, the waveform change part is the changes peculiar to the skin effect of the top of the peak, an inflection point, the rate of climb of the change, quantity of rise change, and rise starting point.

According to this structure, the waveform change part is detected from the top of the peak of the waveform change, an inflection point, the rate of climb of the change, quantity of rise change, and a rise start, and a polishing end point is forecasted from the waveform change part.

The invention according to an embodiment provides a polishing end point forecast/detection method for precisely forecasting/detecting a polishing end point wherein, in a method to forecast and detect from a waveform change part by the skin effect, from the time from the early polishing stage to the waveform change part, and the quantity of polishing from the early polishing stage to the waveform change part, the polishing rate is calculated, and the film thickness calculated by the waveform change part is divided by the polishing rate, and thereby the remaining polishing time required from the waveform change part to polishing end point is calculated, and after polishing is carried out for the calculated time from the waveform change part, the polishing is ended.

According to this structure, with the time from initial polishing to the detection of a polishing end point, and the quantity of polishing reaching to the waveform change part, the polishing rate is calculated. Then, the film thickness corresponding to the waveform change part is divided with the polishing rate, and thereby, the necessary polishing time after detecting the waveform change part is calculated. Therefore, after the detection of the waveform change part, polishing is finished by polishing for the calculated polishing time.

The invention according to an embodiment provides a polishing end point forecast/detection method for precisely forecasting/detecting a polishing end point at the moment when a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by an inductor shape to generate a magnetic field without directivity of the degree that does not penetrate the predetermined conductive film by the skin effect of the predetermined conductive film and the skin effect, and there is at least once of the process in which at least the part of the magnetic flux to penetrate the predetermined conductive film increases with the progress of polishing, and the change of eddy current occurred by the change of the leakage magnetic flux to penetrate the predetermined conductive film during progress of the polishing among magnetic flux formed of the inductor is monitored as the change of a mutual inductance that occurs in the inductor by the eddy current, and a mutual inductance change part to forecast the polishing end point is detected on the basis of the case when the film thickness in polishing becomes same as or close to the skin depth with the skin effect, and the polishing end point is forecasted from change part.

According to this structure, the frequency oscillated from a high frequency inductor type sensor is set in the same manner as the action of the invention according to another embodiment, and furthermore, from an inductor, a magnetic field without the directivity of the degree that does not penetrate the predetermined conductive film by the skin effect of the predetermined conductive film by the shape occurs in the early polishing stage. Then, the change of the leakage magnetic flux occurring with the progress of polishing is monitored as a change of the mutual inductance that occurs in the inductor, and an mutual inductance change part for forecasting a polishing end point is detected on the basis of the change of the mutual inductance after the predetermined conductive film becomes a film thickness corresponding to the skin depth is detected by progress of the polishing, and an polishing end point is forecasted by the change part of the mutual inductance.

The invention according to an embodiment provides a polishing end point forecast/detection method for precisely forecasting/detecting a polishing end point at the moment when a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by an inductor shape to generate a magnetic field without directivity of the degree that does not penetrate the predetermined conductive film by the skin effect of the predetermined conductive film and the skin effect, and there is at least once of the process in which at least the part of magnetic flux to penetrate the predetermined conductive film increases with the progress of polishing, and the change of the inductance of a sensor circuit system in the high frequency inductor type sensor based on the change of the leakage magnetic flux to penetrate the predetermined conductive film during progress of the polishing among magnetic flux formed of the inductor is monitored as the change of the resonance frequency to be determined by the inductance and the intrinsic capacity of the sensor circuit system, and a mutual inductance change part to forecast the polishing end point is detected on the basis of the change of the resonance frequency in the case when the film thickness in polishing becomes corresponding to the film thickness with the skin effect, and the polishing end point is forecasted from the resonance frequency change part.

According to this structure, the frequency oscillated from a high frequency inductor type sensor is set in the same manner as the action of the invention according to another embodiment. Furthermore, from an inductor, a magnetic field without the directivity of the degree that does not penetrate the predetermined conductive film by the skin effect of the predetermined conductive film by the shape occurs in the early polishing stage, and a leakage magnetic flux penetrating the predetermined conductive film occurs with progress of the polishing. Then, the change of the inductance of a sensor circuit system in the high frequency inductor type sensor with the change of the leakage magnetic flux is monitored as the change of the resonance frequency to be determined by the inductance and the intrinsic capacity of the sensor circuit system, the change part of resonance frequency is detected on the basis of the change of the resonance frequency after the predetermined conductive film becomes a film thickness corresponding to the skin depth by progress of the polishing, and an polishing end point is forecasted by the change part of resonance frequency.

The invention according to an embodiment provides a polishing end point forecast/detection method for precisely forecasting/detecting a polishing end point at the moment when a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by an inductor shape to generate a magnetic field without directivity of the degree that does not penetrate the predetermined conductive film by the skin effect of the predetermined conductive film and the skin effect, and there is at least once of the process in which at least the part of the magnetic flux to penetrate the predetermined conductive film increases with the progress of polishing, and at least any one of the change of eddy current that occurs by the change of the leakage magnetic flux penetrating the predetermined conductive film during progress of the polishing among magnetic flux formed of the inductor, the change of a mutual inductance occurring to the inductor by the change of the eddy current, and the change of resonance frequency oscillated from the high frequency inductor type sensor by the change of the inductance of a sensor circuit system in the high frequency inductor type sensor based on the change of the mutual inductance is monitored, and a resonance frequency change part to forecast the polishing end point is detected on the basis of at least any one of the changes in the case when the film thickness in polishing becomes corresponding to the film thickness with the skin effect, and the polishing end point is forecasted from the change part.

According to this structure, the frequency oscillated from a high frequency inductor type sensor is set in the same manner as the action of the invention according to another embodiment. Furthermore, from an inductor, a magnetic field without the directivity of the degree that does not penetrate the predetermined conductive film by the skin effect of the predetermined conductive film by the shape occurs in the early polishing stage, and a leakage magnetic flux penetrating the predetermined conductive film occurs with progress of the polishing. Then, at least any one of the change of eddy current that occurs by the change of the leakage magnetic flux, the change of a mutual inductance with the change of the eddy current, and the change of resonance frequency oscillated from the high frequency inductor type sensor based on the change of the mutual inductance is monitored, and the change part of a resonance frequency change part is detected on the basis of at least any one of change of eddy current after the film thickness of the predetermined conductive film is decreased to that corresponding to the skin depth by the progress of polishing, the change of a mutual inductance, and the change of resonance frequency, and the polishing end point is forecasted from the resonance frequency change part.

The invention according to an embodiment provides a polishing end point forecast/detection method for precisely forecasting/detecting a polishing end point wherein, during each change of the eddy current, the mutual inductance or the resonance frequency when the film thickness of the predetermined conductive film in polishing becomes that corresponding to the skin depth, the maximum point (peak) occurs by operating two phenomena of the increase of the eddy current by the increase in the leakage magnetic flux to produce at a film thickness corresponding to the skin depth and the decrease of the eddy current formation region with the decrease in the film thickness volume by the polishing, and the change part is detected on the basis of the maximum point (peak).

According to this structure, further to the action of the invention of another embodiment, the maximum point (peak) occurs during each change of the eddy current, the mutual inductance or the resonance frequency after the film thickness of the predetermined conductive film in polishing becomes that corresponding to the skin depth. The waveform change part for forecasting a polishing end point is detected on the basis of this maximum point (peak), and a polishing end point is forecasted from the change part.

The invention according to an embodiment provides a real-time film thickness monitoring method for monitoring a film thickness change during polishing for evaluating whether a predetermined conductive film is appropriately removed when a conductive film is polished, wherein an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of the magnetic flux to penetrate the predetermined conductive film increases with the progress of polishing, and the change of the leakage magnetic flux to penetrate the predetermined conductive film during progress of the polishing among magnetic flux formed of the inductor is monitored, and a leakage magnetic flux change part to forecast an polishing end point from the change of the leakage magnetic flux at the moment when the film thickness in polishing becomes a film thickness corresponding to the skin effect is detected, and a polishing rate and a remaining film thickness amount to be removed are calculated on the basis of the change part on the spot.

According to this structure, the frequency that it is oscillated from the high frequency inductor type sensor so that the skin effect in which leakage magnetic flux to penetrate the predetermined conductive film begins to occur is set with progress of the polishing without magnetic flux formed of an inductor penetrating the predetermined conductive film almost in early stage of polishing. And, change part to forecast an polishing end point from the change of the leakage magnetic flux after the film thickness in polishing becomes a film thickness corresponding to the skin effect is detected, and respective polishing data of polishing rate and the like are calculated on the spot from the remaining film thickness to be removed to be almost same as the skin depth, and the already removed film thickness amount and the time required therefor are calculated on the basis of the change part, and it is evaluated whether the predetermined conductive film is appropriately removed.

The invention according to an embodiment provides a real-time film thickness monitoring method of monitoring a film thickness change during polishing for evaluating whether a predetermined conductive film is appropriately removed when a conductive film is polished, wherein an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of the magnetic flux to penetrate the predetermined conductive film increases with the progress of polishing, and the change of the leakage magnetic flux to penetrate the predetermined conductive film during progress of the polishing among magnetic flux formed of the inductor is monitored as the change of an eddy current that the leakage magnetic flux produces, and a leakage magnetic flux change part to forecast an polishing end point from the change of the leakage magnetic flux at the moment when the film thickness in polishing becomes a film thickness corresponding to the skin effect is detected, and a polishing rate and a remaining film thickness amount to be removed are calculated on the basis of the change part on the spot.

According to this structure, the frequency oscillated by a high frequency inductor type sensor is set in the same manner as the action of the invention according to another embodiment. And, the change of the leakage magnetic flux is monitored as a change of the eddy current, and the change part is detected by the change of the eddy current after the predetermined conductive film becomes a film thickness corresponding to the skin depth, and respective polishing data of polishing rate and the like are calculated on the spot from the remaining film thickness to be removed to be almost same as the skin depth, and the already removed film thickness amount and the time required therefor on the basis of the change part, and it is evaluated whether the predetermined conductive film is appropriately removed.

The invention according to an embodiment provides a real-time film thickness monitoring method of monitoring a film thickness change during polishing for evaluating whether a predetermined conductive film is appropriately removed when a conductive film is polished, wherein an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of the magnetic flux to penetrate the predetermined conductive film increases with the progress of polishing, and the change of the eddy current occurring by the leakage magnetic flux to penetrate the predetermined conductive film during progress of the polishing among magnetic flux formed of the inductor is monitored as the change of a mutual inductance occurring in the inductor by the eddy current, and a mutual inductance change part to forecast a polishing end point at the moment when the film thickness in polishing becomes a film thickness corresponding to the skin effect is detected, and a polishing rate and a remaining film thickness amount to be removed are calculated on the basis of the change part on the spot.

According to this structure, the frequency oscillated by a high frequency inductor type sensor is set in the same manner as the action of the invention according to another embodiment. And, the change of the leakage magnetic flux is monitored as a change of the mutual inductance occurring in the inductor, and the mutual inductance change part is detected by the change of the mutual inductance after the predetermined conductive film becomes a film thickness corresponding to the skin depth with the progress of polishing, and respective polishing data of polishing rate and the like are calculated on the spot from the remaining film thickness amount to be removed to be almost same as the skin depth, and the already removed film thickness amount and the time required therefor on the basis of the change part, and it is evaluated whether the predetermined conductive film is appropriately removed.

The invention according to an embodiment provides a real-time film thickness monitoring method for monitoring a film thickness change during polishing for evaluating whether a conductive film is polished and a predetermined conductive film is appropriately removed, wherein an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of the magnetic flux to penetrate the predetermined conductive film increases with the progress of polishing, and the change of the inductance of a sensor circuit system in the high frequency inductor type sensor based on the change of the leakage magnetic flux to penetrate the predetermined conductive film during progress of the polishing among magnetic flux formed of the inductor is monitored as the change of the resonance frequency to be determined by the inductance and the intrinsic capacity of the sensor circuit system, and a resonance frequency change part to forecast the polishing end point is detected from the resonance frequency change in the case when the film thickness in polishing becomes corresponding to the skin depth, and a polishing rate and a remaining film thickness amount to be removed are calculated on the basis of the change part on the spot.

According to this structure, the frequency oscillated by a high frequency inductor type sensor is set in the same manner as the action of the invention according to another embodiment. And, the change of the inductance of a sensor circuit system in the high frequency inductor type sensor based on the change of the leakage magnetic flux is monitored as the change of the resonance frequency to be determined by the inductance and the intrinsic capacity of the sensor circuit system, and the resonance frequency change part to forecast an polishing end point is detected from the change of the resonance frequency after the predetermined conductive film becomes a film thickness corresponding to the skin depth with the progress of polishing, and respective polishing data of polishing rate and the like are calculated on the spot from the remaining film thickness to be removed to be almost same as the skin depth, and the already removed film thickness amount and the time required therefor on the basis of the change part, and it is evaluated whether the predetermined conductive film is appropriately removed.

The invention according to an embodiment provides a real-time film thickness monitoring method wherein, during each change of the eddy current, the mutual inductance or the resonance frequency when the film thickness of the predetermined conductive film in polishing becomes same as or close to the skin depth, two phenomena of the increase of the eddy current by the increase in the leakage magnetic flux by the skin effect and the decrease of the eddy current with the decrease in the film thickness volume by the polishing work, and a peak occurs, and the change part to forecast a polishing end point is detected on the basis of the peak.

According to this structure, furthermore to the action of the invention of other embodiments, the peak occurs during each change of the eddy current, the mutual inductance or the resonance frequency after the film thickness of the predetermined conductive film polishing becomes a film thickness corresponding to the skin depth with the progress of polishing. The change part to forecast a polishing end point is detected on the basis of this peak.

The invention according to an embodiment provides a polishing end point forecast/detection device for forecasting/detecting a polishing end point at the moment when a conductive film is polished and a predetermined conductive film is appropriately removed, having a high frequency inductor type sensor equipped with an oscillation circuit constituting a sensor circuit system consisted of a planar inductor and a capacitor, wherein the polishing end point forecast/detection method according to the other embodiments is carried out.

According to this structure, a polishing end point forecast/detection device having the high frequency inductor type sensor comprising the oscillation circuit constituting sensor circuit system consisted of the planar inductor and capacitors sets the oscillation frequency of the high frequency inductor type sensor so that the skin depth in the predetermined conductive film is smaller than the initial film thickness of the predetermined conductive film, and larger than the film thickness of the predetermined conductive film in the polishing end stage. Thereby, the magnetic flux induced to the predetermined conductive film by the magnetic flux formed of the planar inductor at the early polishing stage passes a region of the skin depth almost in parallel with the film side, and when the polishing progresses, at least part of the magnetic flux penetrates the predetermined conductive film and a leakage magnetic flux begins to occur. Then, at least any one of the change of leakage magnetic flux in polishing, the change of eddy current that occurs by the change of the leakage magnetic flux, the change of a mutual inductance occurring to the inductor by the change of the eddy current, and the change of resonance frequency oscillated from the high frequency inductor type sensor by the change of the inductance of a sensor circuit system based on the change of the mutual inductance is monitored, and thereby the change part before the polishing end point is detected on the basis of at least any one of the respective changes after the predetermined conductive film becomes the film thickness corresponding to the skin depth with the progress of polishing, and a polishing end point is forecasted from the change part.

The invention according to an embodiment provides a real-time film thickness monitoring device for monitoring a film thickness change in the polishing progress to evaluate whether a conductive film is polished and the predetermined conductive film is appropriately removed, having a high frequency inductor type sensor equipped with an oscillation circuit constituting a sensor circuit system consisted of a planar inductor and a capacitor, wherein the real-time film thickness monitoring method according to other embodiments is carried out.

According to this structure, the real-time film thickness monitoring device having a high frequency inductor type sensor equipped with an oscillation circuit constituting a sensor circuit system consisted of a planar inductor and a capacitor sets the oscillation frequency of the high frequency inductor type sensor so that the skin depth in the predetermined conductive film is smaller than the initial film thickness of the predetermined conductive film, and larger than the film thickness of the predetermined conductive film in the polishing end stage. Thereby, the magnetic flux induced to the predetermined conductive film by the magnetic flux formed of the planar inductor at the early polishing stage passes a region of the skin depth almost in parallel with the film side, and when the polishing progresses, at least part of the magnetic flux penetrates the predetermined conductive film and a leakage magnetic flux begins to occur. Then, at least any one of the change of leakage magnetic flux in polishing, the change of eddy current that occurs by the change of the leakage magnetic flux, the change of a mutual inductance occurring to the planar inductor by the change of the eddy current, and the change of resonance frequency oscillated from the high frequency inductor type sensor by the change of the inductance of a sensor circuit system based on the change of the mutual inductance is monitored, and thereby, the change part just before the polishing end point is detected from at least any one of the changes after the predetermined conductive film become the film thickness corresponding to the skin depth, respective polishing data of polishing rate and the like are calculated on the spot from the remaining film thickness to be removed to be almost same as the skin depth, and the already removed film thickness amount and the time required therefor on the basis of the change part, and it is evaluated whether the predetermined conductive film is appropriately removed.

EFFECTS OF THE INVENTION

In the invention according to claim 1, an inductor in a high frequency inductor type sensor is arranged adjacent to the predetermined conductive film, and a magnetic flux change induced in the predetermined conductive film by a magnetic flux formed of the inductor is monitored, and by use of a magnetic flux change that occurs by the skin effect in which a film thickness in polishing is determined by the material of the predetermined conductive film as a factor, a magnetic flux change part to forecast a polishing end point is detected from the change part, and an polishing end point is forecasted from the magnetic flux change part, therefore, the magnetic flux induced by the predetermined conductive film passes a region of the skin depth almost in parallel with the film side at the early stage of polishing. Accordingly, it is possible to prevent strong magnetic flux from reaching to minute wires formed in a film, and restrain the occurrence of the eddy current, and suppress the Joule heat loss due to eddy current to the minimum. After the predetermined conductive film became the film thickness corresponding to the skin depth by progress of the polishing, leakage magnetic flux to penetrate the predetermined conductive film occurs, and an eddy current is induced in the predetermined conductive film by this leakage magnetic flux. This eddy current slowly increases by the increase in the leakage magnetic flux with the decrease of the film thickness and decrease rapidly so that conductive film itself which generates an eddy current by the decrease of the further film thickness decreases. By the increase in this eddy current and rapid decrease after that, the inductance of sensor circuit system decreases once and turns for increase afterwards. A peak (inflection point) occurs to the waveform of a resonance frequency oscillated by this behavior from a high frequency inductor type sensor. Then, the peak (inflection point) appears at the position corresponding to the remaining film thickness consistently without fluctuation due to various external disturbances. Therefore, it is detected on the basis of the peak (inflection point) and there is an advantage that it is possible to precisely forecast/detect a polishing end point from the magnetic flux change part.

In the invention according to claim 2, the method to detect a magnetic flux change part by the skin effect detects the changes peculiar to the skin effect of the top of the peak, a inflection point, the rate of climb of the change, quantity of rise change, and a change of the rise starting point, thereby, the forecast/detection of the polishing end point is performed extremely appropriately.

In the invention according to claim 3, the method to detect a magnetic flux change part by the skin effect detects the changes peculiar to the skin effect of a waveform peak point, an inflection point, and predetermined rate of climb point, thereby, the forecast/detection of the polishing end point is performed extremely appropriately.

In the invention according to claim 4, a high frequency inductor type sensor adjacent to the conductive film is a two-dimensional planar inductor, therefore, the magnetic flux formed in the two-dimensional planar inductor for the predetermined conductive film diffuses moderately, and does not have directivity, therefore, the magnetic flux does not invade the inside of the conductive film positively until the predetermined conductive film becomes a film thickness corresponding to the skin depth with the progress of polishing. Further, by the skin effect, the magnetic flux cannot invade the inside of the conductive film, thereby, it is possible to effectively prevent disconnection by the Joule heat by the eddy current occurrence in the device wafer inside and electromigration by an excessive electric current.

In the invention according to claim 5, the high frequency inductor type sensor adjacent to the conductive film is of a structure in which a conductive film is formed on the surface of a substrate formed of an insulator, therefore, it is possible to manufacture a sensor in easy and low cost manner, by deposing or applying an conductive substance such as Cu on glass/epoxy and a substrate of an insulator such as a printed substrate and paper/phenol and the like. Furthermore, it is possible to produce line width extremely finely by etching after formulation of a conductive film on a substrate of an insulator, and miniaturize the sensor size itself. By the miniaturization of the sensor, it is possible to generate a further fine magnetic field efficiently, and it is possible to precisely detect change behaviors of the vicinity of the end point of film removal, without penetrating the magnetic field deeply into the inside of the conductive film.

In the invention according to claim 6, the monitor of the magnetic flux change that is induced on the basis of the skin effect of the predetermined conductive film is at least one of the measurement of the eddy current of the whole predetermined conductive film, the measurement of the mutual inductance which occurs because the predetermined conductive film generates an eddy current, the measurement of the change of the inductance change of the sensor circuit system in the high frequency inductor type sensor by the mutual inductance of the predetermined conductive film, and the measurement of changes of resonance frequency that the high frequency inductor type sensor oscillates inductance change of the sensor circuit system, therefore, the monitor of the magnetic flux change that is induced on the predetermined conductive film in the invention of the claim 1 uses at least any change of the eddy current with the magnetic flux change, mutual inductance, inductance of the sensor circuit system or resonance frequency that a high frequency inductor type sensor oscillates, and thereby the change part of the resonance frequency to forecast the polishing end point before the polishing end point is detected with further ease and precision.

In the invention according to claim 7, an oscillator and a frequency counter to monitor a change of the oscillation (resonance) frequency are arranged adjacent to the high frequency inductor type sensor, therefore it is possible to precisely detect the changes of the magnetic flux with the progress of polishing of the conductive film in the vicinity of an inductor type sensor, while forming a distributed constant circuit in conventional wiring/line part between an oscillator that oscillates the high frequency inductor type sensor and a frequency counter and preventing the inductance and the capacitance of the circuit from becoming unnecessarily large.

In the invention according to claim 8, the magnetic flux change that is induced on the basis of the skin effect of the predetermined conductive film, the change of the eddy current, and the change of the mutual inductance and the change of the resonance frequency include two changes of the change that the eddy current increases by the increase in the penetration magnetic flux with film thickness decrease and the change that the eddy current formation regions substantially decrease with the sequent film thickness decrease, therefore, when the predetermined conductive film becomes less than the film thickness corresponding to the skin depth by progress of the polishing, an eddy current, the mutual inductance and the resonance frequency increase with the increase of the penetration magnetic flux. After that, eddy current formation regions substantially decrease with the decrease of the film thickness by the progress of the further polishing, and an eddy current, the mutual inductances and the resonance frequency rapidly decrease. By these behaviors, after the predetermined conductive film becomes the film thickness corresponding to the skin depth, a peak (an inflection point) occurs to the waveform of an eddy current, a mutual inductance and the resonance frequency and it is possible to clearly detect the change part of the waveform definitely on the basis of this peak (an inflection point).

In the invention according to claim 9, an inductor in the high frequency inductor type sensor is arranged adjacent to the predetermined conductive film, and the inductor shape and the frequency band in which a mutual inductance induced on a conductive film by the increase in magnetic flux to penetrate the conductive film of the polishing target with film thickness decrease by the polishing process are selected, and a magnetic flux change induced on the predetermined conductive film by magnetic flux formed of the inductor is monitored, and the magnetic flux change in which a film thickness in polishing appears by skin effect conspicuously is used, and a magnetic flux change part to forecast a polishing end point is detected, and an polishing end point is forecasted from the magnetic flux change part, therefore, the magnetic flux induced at the early polishing stage by the predetermined conductive film passes a region of the skin depth along a film side approximately in parallel, and after the predetermined conductive film becomes lower than film thickness corresponding to the skin depth by progress of the polishing, a penetration magnetic flux to penetrate the conductive film of the polishing target occurs, and an eddy current and mutual inductances increase with the increase of the penetration magnetic flux. Afterwards, the eddy current formation region substantially decreases with the decrease of the film thickness by the progress of the further polishing, and an eddy current and the mutual inductance rapidly decreases. By these behaviors the magnetic flux change part is detected and the polishing end point is precisely forecasted/detected from the change part.

In the invention according to claim 10, the frequency band to be selected is 20 MHz or more in the case when the material of the predetermined conductive film is Cu, therefore, in the case when the material of the predetermined conductive film is Cu, the skin depth set in smaller than the initial film thickness of the predetermined conductive film in the early polishing stage and, with the progress of polishing, the conductive film becomes the film thickness corresponding to the skin depth at before the polishing end point and the leakage magnetic flux that penetrates the predetermined conductive film occurs.

In the invention according to claim 11, an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by the skin effect of the predetermined conductive film, and there is at least once of the process in which at least the part of magnetic flux to penetrate the predetermined conductive film increases with the progress of polishing, and the change of the leakage magnetic flux to penetrate the predetermined conductive film during progress of the polishing among magnetic flux formed of the inductor is monitored, and by use of the change of the leakage magnetic flux with the skin effect in a film thickness in polishing, a leakage magnetic flux change part to forecast a polishing end point is detected, the polishing end point is forecasted from the change part, therefor, after the predetermined conductive film becomes a film thickness corresponding to the skin depth by the progress of polishing, a leakage magnetic flux that penetrates the predetermined conductive film occurs, on the basis of the change of the leakage magnetic flux, the film thickness reference point is detected at before the polishing end point. Accordingly, it is possible to precisely forecast/detect a polishing end point from the change part of the leakage magnetic flux.

In the invention according to claim 12, an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the conductive film by an inductor shape to generate a magnetic field without directivity of the degree that does not penetrate the predetermined conductive film by the skin effect of the predetermined conductive film and the skin effect, and there is at least once of the process in which at least the part of magnetic flux to penetrate the predetermined conductive film increases with the progress of polishing, and the change of leakage magnetic to penetrate the predetermined conductive film during the progress of polishing among magnetic flux formed of the inductor is monitored as the change of a eddy current generated by the leakage magnetic flux, and a change part of the leakage magnetic flux to forecast the polishing end point is detected in the case when the film thickness in polishing becomes same as or close to the skin depth with the skin effect on the basis of the change of the eddy current, and the polishing end point is forecasted from the change part, and from an inductor, by the shape, a magnetic field without the directivity of the degree that does not penetrate the predetermined conductive film by the skin effect of the predetermined conductive film in the early polishing stage occurs, thereby preventing strong magnetic flux from reaching to minute wires formed in a film, restraining the occurrence of the eddy current, and suppressing the Joule heat loss due to eddy current at the minimum. After the predetermined conductive film becomes a film thickness corresponding to the skin depth by the progress of polishing, a leakage magnetic flux that penetrates the predetermined conductive film occurs, and on the basis of the change of the eddy current that occurs by the change of the leakage magnetic flux, the change part of the eddy current before a polishing end point is detected. Accordingly, it is possible to precisely forecast/detect a polishing end point from the change part.

In the invention according to claim 13, in a method to forecast a polishing end point from a waveform change part by the skin effect, after polishing for a polishing time set beforehand from the waveform change part, the polishing is ended, therefore, the waveform change part is detected at the moment when the remaining film amount becomes a film thickness corresponding to the skin depth. Accordingly, from the remaining film amount and the polishing rate to be carried out, it is possible to set a required polishing time beforehand after detection of the waveform change part. Therefore, polishing is ended after polishing for the polishing time set beforehand from the detected waveform change part, and thereby it is possible to accurately polish and remove the predetermined conductive film.

In the invention according to claim 14, the waveform change part detects the change parts peculiar to the skin effect characteristics of the top of the peak, an inflection point, the rate of climb of the change, quantity of rise change, and the rise starting point, therefore, it is possible to precisely forecast a polishing end point.

In the invention according to claim 15, in a forecast/detection method from a waveform change part by the skin effect to a polishing end point, from the time and the quantity of polishing from the early polishing stage to the waveform change part, the polishing rate is calculated, and the film thickness of the waveform change part is divided by the polishing rate, and thereby the remaining polishing time required from the waveform change part to polishing end point is calculated, and after polishing is carried out for the calculated time from the waveform change part, the polishing is ended, therefore, by detecting the waveform change part from the required time and the quantity of polishing for the detection, the polishing rate is calculated. When a polishing rate after the detection of the waveform change part is taken the same as the polishing rate before the detection of the waveform change part and the polishing after the detection of the waveform change part is carried out, the film thickness corresponding to the skin depth that is a remaining film amount in the waveform change part is divided by the polishing rate, and thereby, the required polishing time after the waveform change part detection is calculated. Therefore, after the detection of the waveform change part, by polishing for the calculated polishing time, it is possible to precisely polish and remove the predetermined conductive film.

In the invention according to claim 16, an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by an inductor shape to generate a magnetic field without directivity of the degree that does not penetrate the predetermined conductive film by the skin effect of the predetermined conductive film and the skin effect, and there is at least once of the process in which at least the part of the magnetic flux to penetrate the predetermined conductive film increases with the progress of polishing, and the change of the eddy current produced by the change of the leakage magnetic flux to penetrate the predetermined conductive film during progress of the polishing among magnetic flux formed of the inductor is monitored as the change of the mutual inductance that occurs in the inductor by the eddy current, and a mutual inductance change part to forecast the polishing end point is detected in the case when the film thickness in polishing becomes same as or close to the skin depth with the skin effect on the basis of the change of the mutual inductance, and the polishing end point is forecasted from the change part, and from an inductor, by the shape, a magnetic field without the directivity of the degree that does not penetrate the predetermined conductive film by the skin effect of the predetermined conductive film in the early polishing stage occurs, thereby preventing strong magnetic flux from reaching to minute wires formed in a film, restraining the occurrence of the eddy current, and suppressing the Joule heat loss due to eddy current at the minimum. After the predetermined conductive film becomes a film thickness corresponding to the skin depth by the progress of polishing, a leakage magnetic flux that penetrates the predetermined conductive film occurs, and on the basis of the change of the mutual inductance that occurs in an inductor by the change of an eddy current with the change of the leakage magnetic flux, the mutual inductance to forecast a polishing end point before a polishing end point is detected. Accordingly, it is possible to precisely forecast/detect a polishing end point from the change part.

In the invention according to claim 17, an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by an inductor shape to generate a magnetic field without directivity of the degree that does not penetrate the predetermined conductive film by the skin effect of the predetermined conductive film and the skin effect, and there is at least once of the process in which at least the part of magnetic flux to penetrate the predetermined conductive film increases with the progress of polishing, and the change of the inductance of a sensor circuit system in the high frequency inductor type sensor based on the change of the leakage magnetic flux to penetrate the predetermined conductive film during progress of the polishing among magnetic flux formed of the inductor is monitored as the change of the resonance frequency to be determined by the inductance and the intrinsic capacity of the sensor circuit system, and the change part of a mutual inductance to forecast the polishing end point is forecasted on the basis of the change of the resonance frequency in the case when the film thickness in polishing becomes corresponding to the skin effect, and the polishing end point is forecasted from the resonance frequency change part, therefore, from an inductor, by the shape, a magnetic field without the directivity of the degree that does not penetrate the predetermined conductive film by the skin effect of the predetermined conductive film in the early polishing stage occurs, thereby preventing strong magnetic flux from reaching to minute wires formed in a film, restraining the occurrence of the eddy current, and suppressing the Joule heat loss due to eddy current at the minimum. After the predetermined conductive film becomes that corresponding to the skin depth by progress of the polishing, the leakage magnetic flux that penetrates the predetermined conductive film occurs, and on the basis of the change of the resonance frequency that is oscillated by a high frequency inductor type sensor by the change of the inductance of a sensor circuit system with the change of the leakage magnetic flux, the change part of the resonance frequency to forecast a polishing end point before the polishing end point is detected. Accordingly, it is possible to precisely forecast/detect a polishing end point from the change part.

In the invention according to claim 18, an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by an inductor shape to generate a magnetic field without directivity of the degree that does not penetrate the predetermined conductive film by the skin effect of the predetermined conductive film and the skin effect, and there is at least once of the process in which at least the part of the magnetic flux to penetrate the predetermined conductive film increases with the progress of polishing, and at least any one of the change of eddy current that occurs by the change of the leakage magnetic flux penetrating the predetermined conductive film during progress of the polishing among magnetic flux formed of the inductor, the change of a mutual inductance occurring to the inductor by the change of the eddy current, and the change of resonance frequency oscillated from the high frequency inductor type sensor by the change of the inductance of a sensor circuit system in the high frequency inductor type sensor based on the change of the mutual inductance is monitored, and a change part to forecast the polishing end point is forecasted on the basis of at least any one of the changes, and the polishing end point is forecasted from the change part, therefore, from an inductor, a magnetic field without the directivity of the degree that does not penetrate the predetermined conductive film by the skin effect of the predetermined conductive film by the shape in the early polishing stage occurs, thereby preventing strong magnetic flux from reaching to minute wires formed in a film, restraining the occurrence of the eddy current, and suppressing the Joule heat loss due to eddy current at the minimum. After the predetermined conductive film becomes that corresponding to the skin depth by progress of the polishing, a leakage magnetic flux for penetrating the predetermined conductive film occurs with progress of the polishing. Then, on the basis of at least any one of the change of eddy current that occurs by the change of the leakage magnetic flux, the change of a mutual inductance, and the change of resonance frequency oscillated from the high frequency inductor type sensor, the change part before the polishing end point is detected. Accordingly, it is possible to precisely forecast/detect a polishing end point from the change part.

In the invention according to claim 19, during each change of the eddy current, the mutual inductance or the resonance frequency when the film thickness of the predetermined conductive film in polishing becomes that corresponding to the skin depth, the maximum point (peak) occurs by operating two phenomena of the increase of the eddy current by the increase in the leakage magnetic flux to produce at a film thickness corresponding to the skin depth and the decrease of the eddy current formation region with the decrease in the film thickness volume by the polishing, and the change part for forecasting the polishing end point is detected on the basis of the maximum point (peak), therefore, in addition to the effect of the present invention according to the claim 17, the maximum point (peak) further occurs during each change of the eddy current, the mutual inductance or the resonance frequency after the film thickness of the predetermined conductive film becomes that corresponding to the skin depth by the progress of polishing. The change part for forecasting the polishing end point is appropriately detected on the basis of this maximum point (peak) Accordingly, it is possible to further precisely forecast/detect a polishing end point from the change part.

In the invention according to claim 20, an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of magnetic flux to penetrate the predetermined conductive film increases with the progress of polishing, and the change of the leakage magnetic flux to penetrate the predetermined conductive film during progress of the polishing among magnetic flux formed of the inductor is monitored, and a change part of the leakage magnetic flux to forecast an polishing end point from the change of the leakage magnetic flux at the moment when the film thickness in polishing becomes a film thickness corresponding to the skin effect is detected, and a polishing rate and a remaining film thickness amount to be removed are calculated on the basis of the change part on the spot, therefore, the leakage magnetic flux that penetrates the predetermined conductive film occurs after the film thickness of the predetermined conductive film becomes that corresponding to the skin depth by the progress of polishing, and the change part before the polishing end point is detected from the change of the leakage magnetic flux. Accordingly, respective polishing data of a remaining film amount to be removed and polishing rate and the like can be calculated on the basis of the change part on the spot, and it is possible to evaluated whether the predetermined conductive film is appropriately removed and to suppress the Joule heat loss due to eddy current occurring in leakage magnetic flux at the minimum.

In the invention according to claim 21, an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of magnetic flux to penetrate the conductive film increases with the progress of polishing, and the change of the leakage magnetic flux to penetrate the predetermined conductive film during progress of the polishing among magnetic flux formed of the inductor is monitored as the change of an eddy current that the leakage magnetic flux produces, and a change part of the leakage magnetic flux to forecast an polishing end point from the change of the eddy current at the moment when the film thickness in polishing becomes that corresponding to the skin effect is detected, and a polishing rate and a remaining film thickness amount to be removed are calculated on the basis of the change part on the spot, therefore, the leakage magnetic film to penetrate the predetermined conductive film is generated after the predetermined conductive film becomes a film thickness corresponding to the skin depth by the progress of polishing, and the change part before the polishing end point is detected by the change of the eddy current with the change of the leakage magnetic flux. Accordingly, it is possible to precisely calculate each polishing data such as the remaining film amount to be removed and polishing rates on the basis of the change part on the spot, and to precisely evaluate whether the predetermined conductive film is appropriately removed.

In the invention according to claim 22, an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of magnetic flux to penetrate the conductive film increases with the progress of polishing, and the change of the eddy current occurring by the change of the leakage magnetic flux to penetrate the predetermined conductive film during progress of the polishing among magnetic flux formed of the inductor is monitored as the change of a mutual inductance occurring in the inductor by the eddy current, and the change part of a mutual inductance to forecast a polishing end point from the change part of the mutual inductance at the moment when the film thickness in polishing becomes that corresponding to the skin effect is detected, and a polishing rate and a remaining film thickness amount to be removed are calculated on the basis of the change part on the spot, therefore, the leakage magnetic flux to penetrate the predetermined conductive film increases is generated after the predetermined conductive film becomes a film thickness corresponding to the skin depth by the progress of polishing, and the change part before the polishing end point is detected from the change of a mutual inductance occurring to the inductor by the change of the eddy current with the change of the leakage magnetic flux. Accordingly, it is possible to precisely calculate each polishing data such as the remaining film amount to be removed and polishing rates on the basis of the change part on the spot, and to precisely evaluate whether the predetermined conductive film is appropriately removed.

In the invention according to claim 23, an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of magnetic flux to penetrate the conductive film increases with the progress of polishing, and the change of the inductance of a sensor circuit system in the high frequency inductor type sensor based on the change of the leakage magnetic flux to penetrate the predetermined conductive film during progress of the polishing among magnetic flux formed of the inductor is monitored as the change of the resonance frequency determined by the inductance and the intrinsic capacity of the sensor circuit system, and a change part of the resonance frequency to forecast the polishing end point is detected from the change of the resonance frequency in the case when the film thickness in polishing becomes that corresponding to the skin effect, and a polishing rate and a remaining film thickness amount to be removed are calculated on the basis of the change part on the spot, therefore, the leakage magnetic flux to penetrate the predetermined conductive film is generated after the predetermined conductive film becomes a film thickness corresponding to the skin depth by the progress of polishing, and the change part before the polishing end point is detected based on the change of a resonance frequency oscillated from the high frequency inductor type sensor by the change of inductance of the sensor circuit system with the change of the leakage magnetic flux. Accordingly, it is possible to precisely calculate each polishing data such as the remaining film amount to be removed and polishing rates on the basis of the change part on the spot, and to precisely evaluate whether the predetermined conductive film is appropriately removed.

In the invention according to claim 24, during each change of the eddy current, the mutual inductance or the resonance frequency when the film thickness of the predetermined conductive film in polishing becomes same as or close to the skin depth, a peak occurs by operating two phenomena of the increase of the eddy current by the increase in the leakage magnetic flux and the decrease of the eddy current with the decrease in the film thickness volume by the polishing, and film thickness reference point is detected on the basis of the peak, thereby, in addition to the effect of the invention of the claims 20, 21 or 22, the peak occurs during each change of the eddy current, the mutual inductance or the resonance frequency after the film thickness of the predetermined conductive film becomes that corresponding to the skin depth, thereby it is possible to detect the change part to forecast the polishing end point based on this peak. Accordingly, it is possible to precisely calculate each polishing data such as the remaining film amount to be removed and polishing rates on the basis of the change part on the spot, and to precisely evaluate whether the predetermined conductive film is appropriately removed.

In the invention according to claim 25, there is provided a polishing end point forecast/detection device for forecasting/detecting a polishing end point at the moment when a conductive film is polished and a predetermined conductive film is appropriately removed, having a high frequency inductor type sensor equipped with an oscillation circuit constituting a sensor circuit system consisting of a planar inductor and a capacitor, wherein the polishing end point forecast/detection method according to claims 1, 2, 3, 4, 5, 6, 7, 8, 9, 10, 11, 12, 13, 14, 15, 16, 17 or 18 is carried out, therefore, a polishing end point forecast/detection device having the high frequency inductor type sensor comprising the oscillation circuit constituting sensor circuit system consisting of the planar inductor and capacitors detect the waveform change part to forecast the polishing end point before the polishing end point based on at least any one of change of leakage magnetic, the change of the eddy current occurred in the planar inductor by the change of the eddy current. Accordingly, it is possible to precisely forecast/detect a polishing end point from the waveform change part, and to suppress the Joule heat loss due to the eddy current occurring by the leakage magnetic flux to the minimum.

In the invention according to claim 26, there is provided a real-time film thickness monitoring device for monitoring a film thickness change of the whole polishing progress to evaluate whether the predetermined conductive film is appropriately removed when a conductive film is polished, having a high frequency inductor type sensor equipped with an oscillation circuit constituting a sensor circuit system consisting of a planar inductor and a capacitor, wherein the real-time film thickness monitoring method according to claims 19, 20, 21, 22 or 23 is carried out, therefore, the real-time film thickness monitoring device having a high frequency inductor type sensor equipped with an oscillation circuit constituting a sensor circuit system consisting of a planar inductor and a capacitor occurs the leakage magnetic flux penetrate the predetermined conductive film after the predetermined conductive film becomes the film thickness corresponding to the skin depth by the progress of polishing, and detects the waveform change part to forecast the polishing end point before the polishing end point based on at least any one of change of leakage magnetic flux, change of eddy current that occurs by the change of the leakage magnetic flux, the change of the mutual inductance that occurs in the planar inductor by the change of the eddy current, and the change of the resonance frequency oscillated from the high frequency inductor type sensor by the change of the inductance of the sensor circuit system. Thereby, it is possible to precisely calculate respective polishing data of the remaining film thickness to be removed and polishing rate and the like on the spot based on the waveform change part, and it is possible to precisely evaluate whether the predetermined conductive film is appropriately removed and to suppress the Joule heat loss due to the eddy current occurring by the leakage magnetic flux to the minimum.

BRIEF DESCRIPTION OF THE DRAWINGS

FIG. 5 are figures showing configuration example of a forecast/detection device of the polishing end point.

FIG. 6 are figures showing basic configuration example of an oscillation circuit in the polishing end point forecast/detection device of FIG. 5.

FIG. 7 are figures showing the results of an electromagnetic simulation to find in which directions of the magnetic field that occurs from a coil is arranged.

FIG. 9 are combined views for explaining a detecting operation of the waveform change part to forecast the magnetic flux and a polishing end point accompanying polishing removal of a conductive film; FIG. 9A to 9D are figures showing change examples of the magnetic flux and the eddy current accompanying polishing removal of a conductive films and FIG. 9E is a characteristic figure showing a change example of the resonance frequency to the film thickness change of the conductive film;

FIG. 10 are combined views showing comparison examples with FIG. 9; FIGS. 10A to 10D are figures showing the change examples of the magnetic flux and the eddy current with the polishing deletion of the conductive film amount, and FIG. 10E is a characteristic figure showing a change example of the resonance frequency to the film thickness change of the conductive film;

FIG. 11 are views showing the results of the evaluation on the peak to become the waveform change part to forecast the polishing end point in a Cu film and a tungsten (W) film that are different in terms of the quality of materials and the conductivity of conductive films to become the polishing targets according to an embodiment of the present invention.

FIG. 12 are figures showing the relation between the film thickness and the resonance frequency in the case where the conductive film of the polishing target is a Cu film.

DESCRIPTION OF PREFERRED EMBODIMENTS

In order to achieve the object suppress Joule heat loss due to the eddy current to the minimum, to precisely forecast/detect an polishing end point, to precisely calculate the remaining film thickness to be removed and polishing rate and the like on the spot, and to precisely evaluate whether the predetermined conductive film is appropriately removed, there is provided a polishing end point forecast/detection method for forecasting/detecting a polishing end point at the moment when a conductive film is polished and a predetermined conductive film is appropriately removed, wherein an inductor in a high frequency inductor type sensor is arranged adjacent to the predetermined conductive film, and a magnetic flux change induced in the predetermined conductive film by a magnetic flux formed of the inductor is monitored, and by use of a magnetic flux change by the skin effect in which a film thickness in polishing is determined by the material of the predetermined conductive film as a factor, a magnetic flux change part to forecast a polishing end point is detected, and a polishing end point is forecasted from the magnetic flux change part.

First Embodiment

Figure 1:
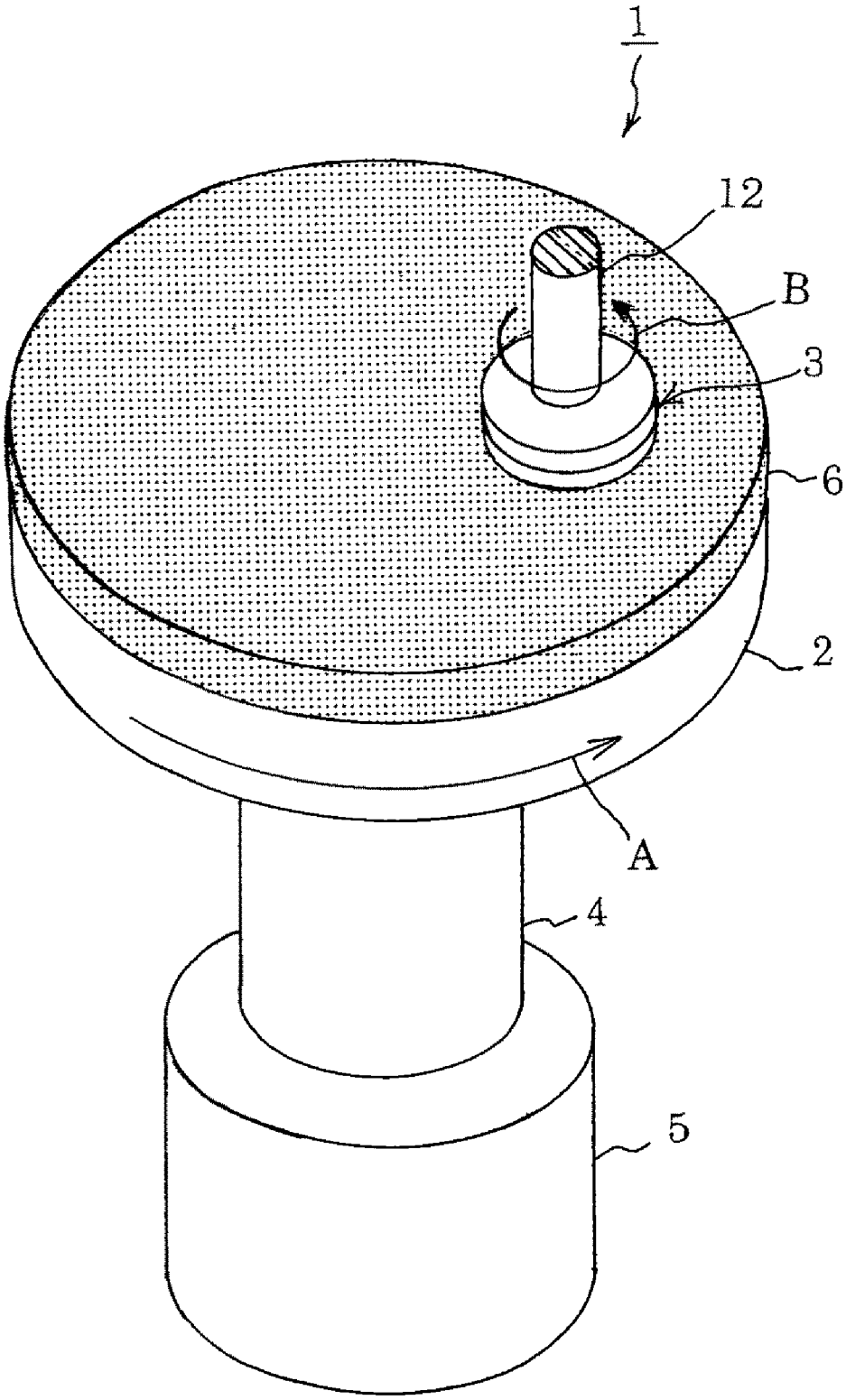
FIG. 1 is a perspective view of a chemical mechanical polishing device incorporated with a polishing end point forecast/detection device according to an embodiment of the present invention.
Figure 3:
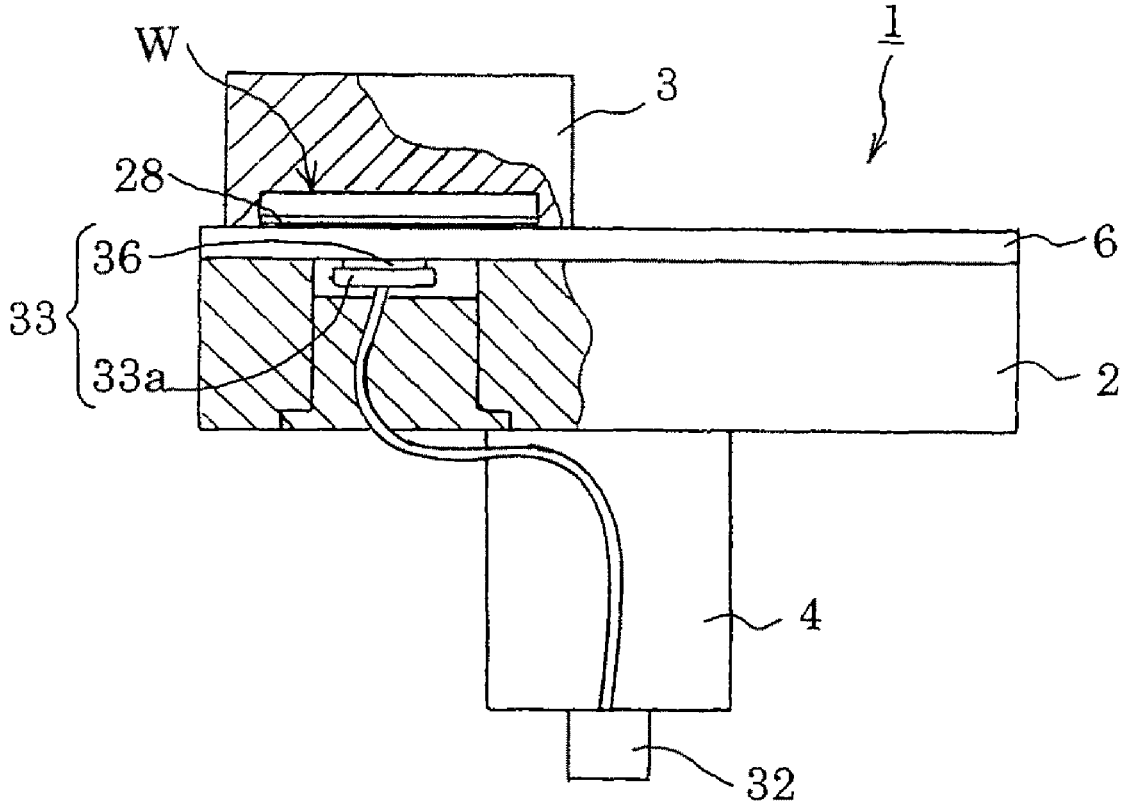
FIG. 3 is a schematic side view showing a partially broken part for explaining the state incorporated with a chemical mechanical polishing device of a polishing end point in a platen according to an embodiment of the present invention.
Figure 4:
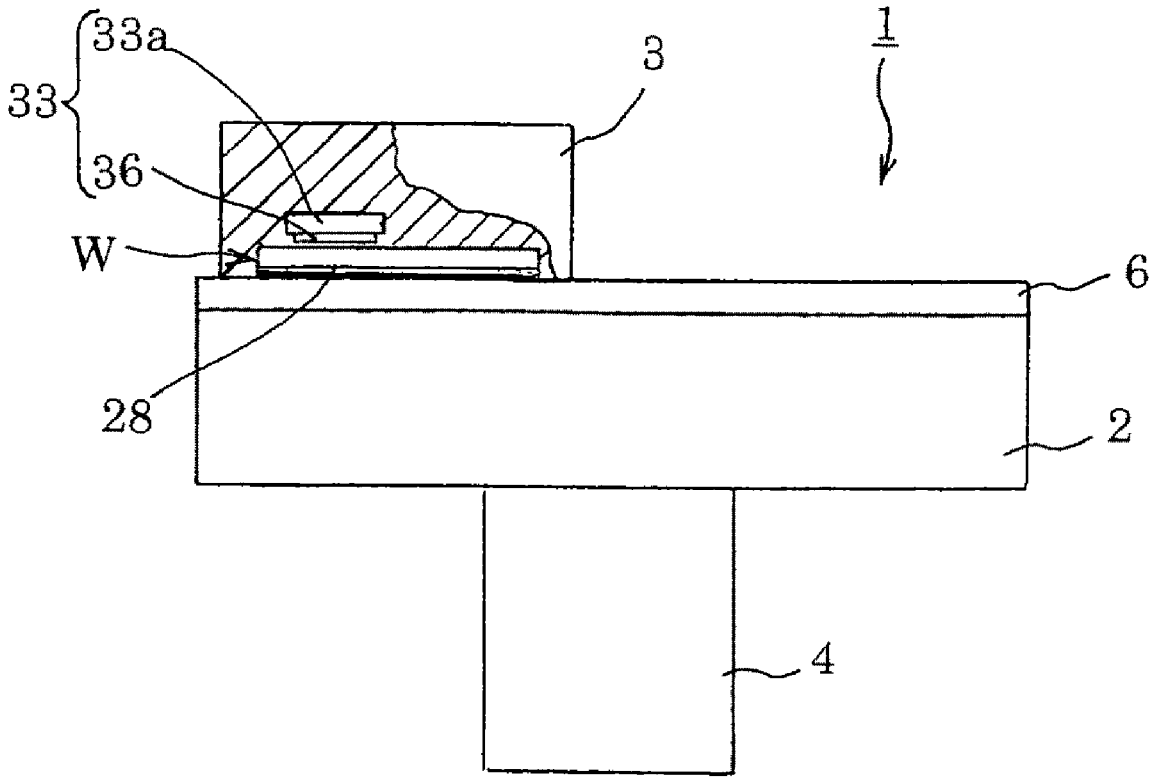
FIG. 4 is a schematic side view showing a partially broken part for explaining the state incorporated with a chemical mechanical polishing device of a polishing end point in a polishing head according to an embodiment of the present invention.

Hereinafter, a polishing end point forecast/detection method and a device thereof according to a first embodiment of the present invention are explained in detail with reference to the attached drawings. FIG. 1 is a perspective view showing a chemical mechanical polishing device into which a forecast/detection device at a polishing end point, FIG. 2 is an enlarged longitudinal sectional view of a polishing head, FIG. 3 is a schematic side view showing a partially broken part for explaining the state in which a chemical mechanical polishing device at a polishing end point is assembled in a platen, and FIG. 4 is a schematic side view showing a partially broken part for explaining the state in which a forecast/detection device at a polishing end point is assembled in a polishing head.

First, a polishing end point forecast/detection method and a structure of a device thereof according to the present embodiment are explained from the structure of a chemical mechanical polishing device applied to the same. In FIG. 1, a chemical mechanical polishing device 1 mainly consists of a platen 2 and a polishing head 3. The platen 2 is formed into the shape of a disk, and a rotation shaft 4 is connected at the center of the lower part thereof, and rotates by the drive of a motor 5 in the arrow direction A. A polishing pad 6 is attached onto the top surface of the platen 2, and slurry that is a mixture of abrasives and chemicals is supplied from a nozzle not illustrated onto the polishing pad 6.

Figure 2:
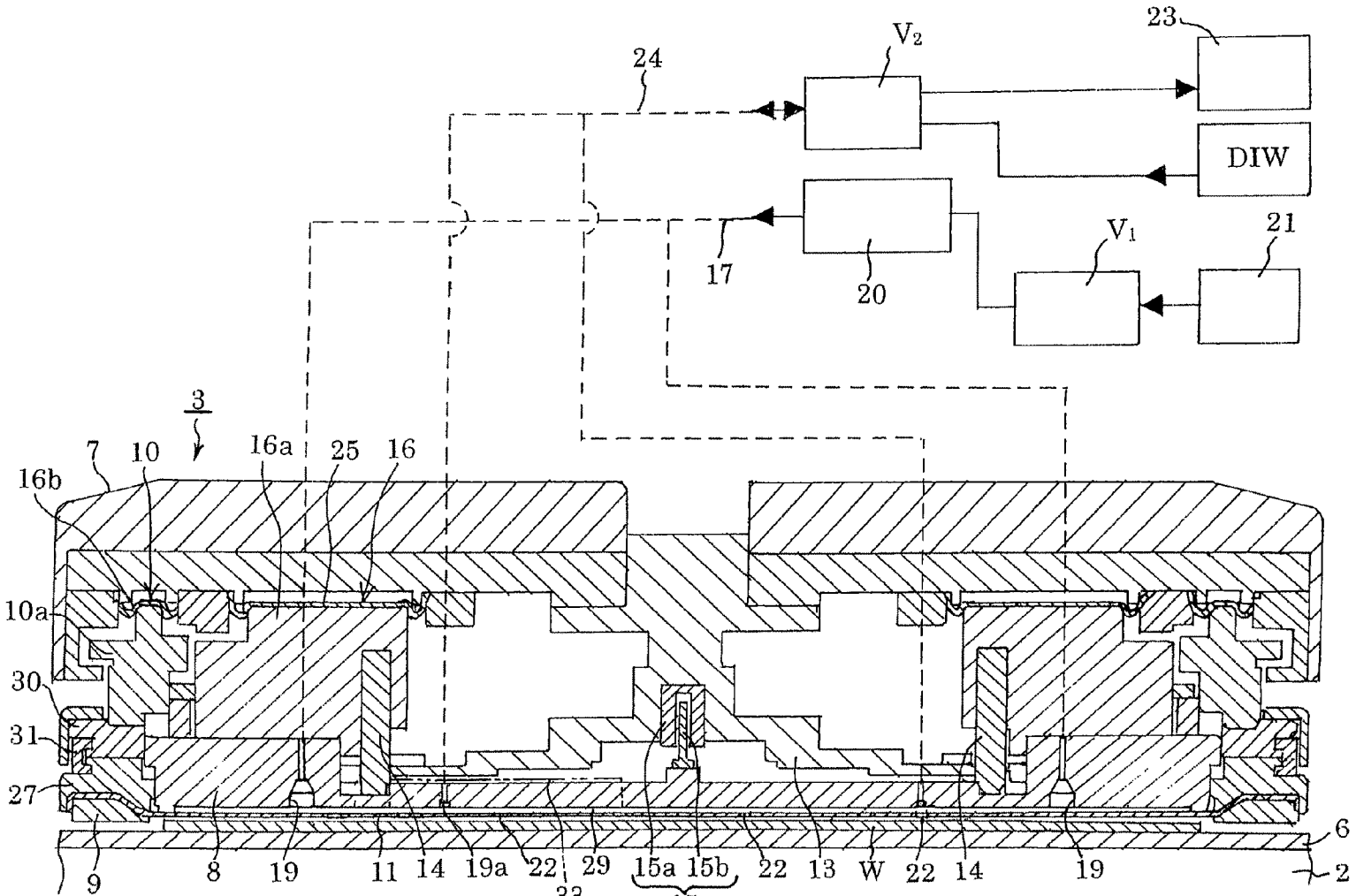
FIG. 2 is an enlarged vertical cross sectional view of a polishing head in the chemical mechanical polishing device of FIG. 1.

The polishing head 3, as shown in FIG. 2, mainly consists of a head main body 7, a carrier 8, a retainer ring 9, a retainer ring press means 10, an elastic sheet 11, a carrier press means 16 and a control means of air and the like.

The head main body 7 is formed into the shape of a disk that is smaller than the platen 2, and a rotation axis 12 (refer to FIG. 1) is connected to the center of the top surface thereof. The head main body 7 is pivoted to the rotation axis 12 and driven by a motor not illustrated and rotates in the arrow direction B of FIG. 1.

The carrier 8 is formed into the shape of a disk, and arranged at the center of the head main body 7. A dry plate 13 is arranged in between the top surface central part of the carrier 8 and the central lower part of the head main body 7, and a rotation is transmitted from the head main body 7 via pins 14 and 14.

An operation transformer main body 15*a* is fixed in between the central lower part of the dry plate 13 and the central upper part of the carrier 8, and further, a core 15*b* of the operation transformer 15 is fixed to the center upper part of the carrier 8, and connected to a control unit not illustrated, and outputs a polishing state signal of a conductive film made of Cu and the like that is formed on a wafer W (the lower side of FIG. 2) to the control unit.

A carrier press member 16*a* is arranged on the upper surface circumference of the carrier 8, and a press power is transmitted from the carrier press means 16 to the carrier 8 through the carrier press member 16*a*.

An air outlet 19 that jets air from an air float line 17 to the elastic sheet 11 is arranged in the lower part of the carrier 8. An aeration pump 21 that is an air supply source is connected via an air filter 20 and an automatic opening/closing valve V1 to the air float line 17. The blow-off of the air from the air outlet 19 is carried out by switching of the automatic opening/closing valve V1.

An hole 22 to blow out vacuum and DIW (pure water) or air at necessity is formed in the lower part of the carrier 8. The absorption of the air is carried out by drive of a vacuum pump 23, and an automatic opening/closing valve V2 is arranged in a vacuum line 24, and by switching of the automatic opening/closing valve V2, the supply of vacuum and DIW is carried out through the vacuum line 24.

The air supply from the air float line 17 and the vacuum action and DIW supply and the like from the vacuum line 24 are carried out by an order signal from the control unit.

Furthermore, the carrier press means 16 is arranged in the lower central circumference of the head main body, and gives a press power to the carrier press member 16*a*, and transmits the press power to the carrier 8 connected thereto. Preferably, this carrier press means 16 consists of an air bag 25 made of a rubber sheet that swells and shrinks by absorption and exhaust of air. An air supply mechanism not illustrated is connected to the air bag 25 to supply air.

The retainer ring 9 is formed into the shape of a ring, and it is arranged in the outer circumference of the carrier 8. This retainer ring 9 is attached to a retainer ring holder 27 arranged in the polishing head 3, and the elastic sheet 11 is arranged in the inner circumference part.

The elastic sheet 11 is formed into the shape of a circle, and a plurality of hole 22 are made therein. The elastic sheet 11 is expanded in the inside of the retainer ring 9 with the circumference thereof being pinched between the retainer ring and the retainer ring holder 27.

In the lower part of the carrier 8 on which the elastic sheet 11 is extended, an air chamber 29 is formed, between the carrier 8 and the elastic sheet 11. The wafer W on which a conductive film is formed is pressed to the carrier 8 through the air chamber 29. The retainer ring holder 27 is attached to an attachment member 30 formed into the shape of a ring via a snap ring 31. A retainer ring press member 10*a* is connected to the attachment member 30. A press power from the retainer ring press means 10 is transmitted to the retainer ring 9 via this retainer ring press member 10*a*.

The retainer ring press means 10 is arranged in the outer circumference of the lower part of the head main body 7, and gives a press power to the retainer ring press member 10*a*, and thereby pushes the retainer ring 9 connected thereto to the polishing pad 6. Preferably, this retainer ring press means 10 consists of an air bag 16*b* made of a rubber sheet in the same manner as the carrier press means 16. An air supply mechanism not illustrated is connected to the air bag 16*b* to supply air.

Then, as shown in FIG. 3 or FIG. 4, a polishing end point forecast/detection device 33 is arranged each in the upper part of the platen 2 or the part of the carrier 8 of the polishing head 3 in the chemical mechanical polishing device 1. When the polishing end point forecast/detection device 33 is incorporated in the platen 2 side, the detection signals such as waveform change parts and the like to forecast a polishing end point are output from the polishing end point forecast/detection device 33 through the slip ring 32 to the outside.

Furthermore, two or more polishing end point forecast/detection device 33 may be incorporated each in the upper part of the platen 2 or the part of the carrier 8 of the polishing head 3. By incorporating two or more polishing end point forecast/detection devices 33, and sampling film thickness information in chronological order from a polishing end point forecast/detection device 33 in a rotational direction, the distribution information of the film thickness change of the conductive film 28 in the wafer W surface is obtained.

Figure 5A:
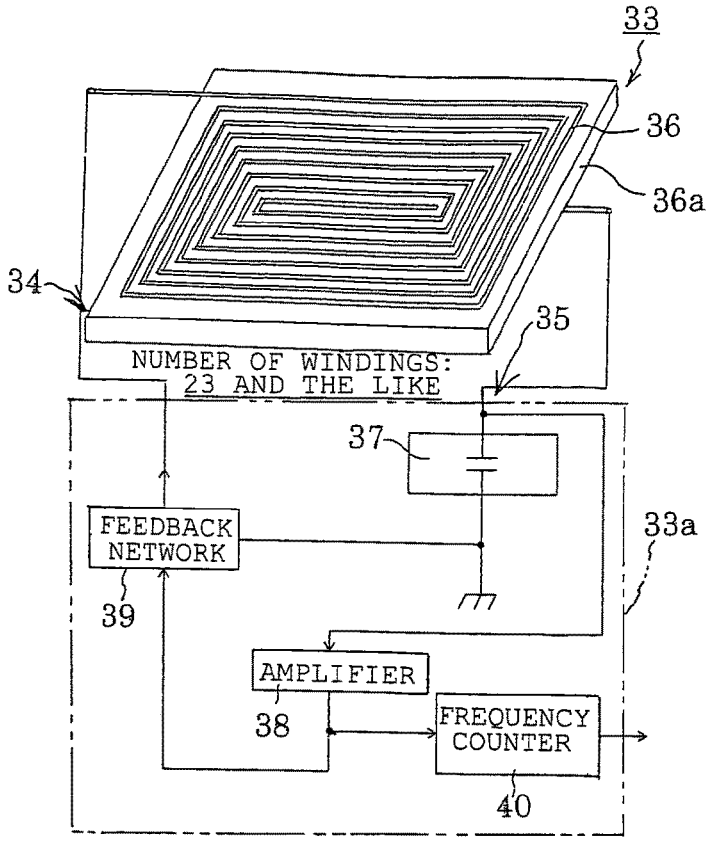
FIG. 5A shows a block diagram.
Figure 5B:
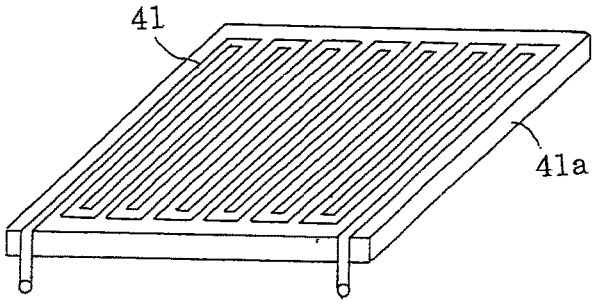
FIG. 5B is a figure showing another configuration example of the planar inductor.
Figure 5C:
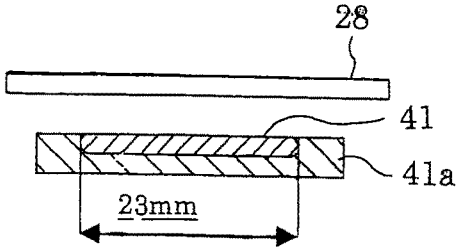
FIG. 5C is a cross sectional view of the planar inductor of FIG. 5B.

FIG. 5 are figures showing configuration example of a polishing end point forecast/detection device 33; FIG. 5A shows a block diagram, FIG. 5B is a figure showing another configuration example of the planar inductor, and FIG. 5C is a cross sectional view of the planar inductor of FIG. 5B. In an oscillation circuit 35 constituting the main body of a high frequency inductor type sensor 34 in the polishing end point forecast/detection device 33, a concentrated constant capacitor 37 to become capacitance Co is connected in series to a two-dimensional planar inductor 36 to become inductance L, and thereby an LC circuit is structured. The planar inductor 36 is structured into a meander shape by use of conductive materials such as Cu and the like, on a substrate 36*a* made of insulators into a square shape.

The planar inductor 36 may be formed, besides the spiral form shown in FIG. 5A, into a meander shape, on the substrate 41*a* in a square shape, like a planar inductor 41 shown in FIG. 5B. Further, it may be made of an unillustrated round shaped spiral. As for the two-dimensional planar inductors 36 and 41, the line width thereof may be manufactured extremely fine by manufacturing by etching and the like, after forming a conductive film such as Cu and the like on substrates 36*a* and 41*a* made of insulators such as glass/epoxy or paper/phenol and the like, and the entire shape thereof may be miniaturized into a square shape with a side of 23 mm, as shown in FIG. 5C. Then, by the miniaturization of the planar inductor 36 and 41, it is possible to efficiently generate a minute magnetic field, and it is possible to precisely detect change behaviors in the vicinity of the end point of removal of the conductive film 28, without making a magnetic field penetrate into the inside of the conductive film 28 deeply.

The output signal from the LC circuit is input into an amplifier 38 that is structured of an operation amplifier and the like, and the output of the amplifier 38 is input into a feedback network 39 that is consisted of resistance and the like. When the output signal of the feedback network 39 is positively fed back to the planar inductor 36, an oscillation circuit 35 including the planar inductor 36 is structured.

Figure 6A:
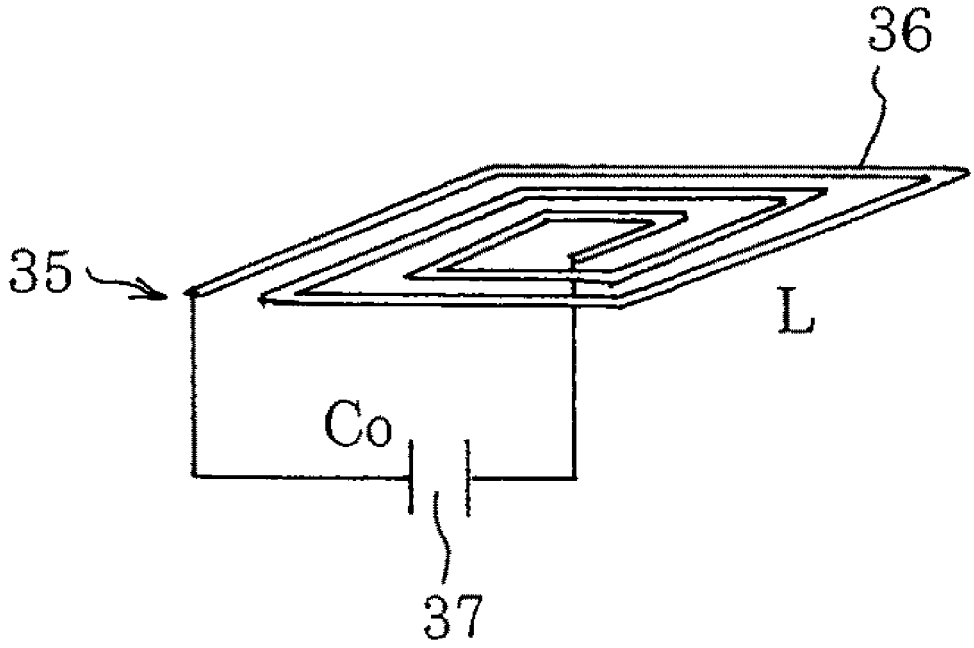
FIG. 6A is a configuration diagram.
Figure 6B:
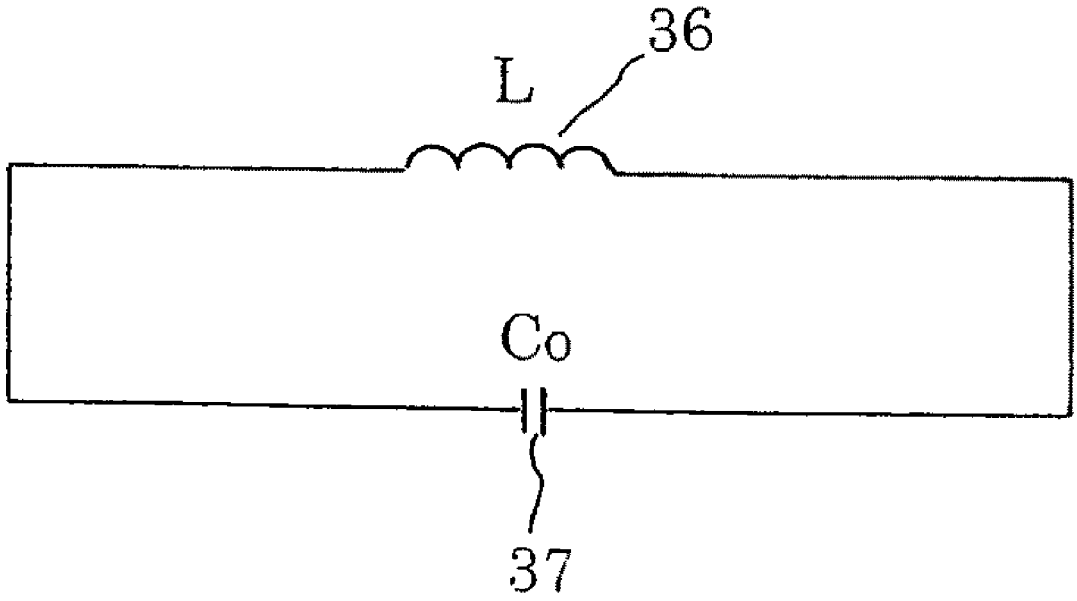
FIG. 6B is an equivalent circuits of FIG. 6A.

The oscillation circuit 35, basically, as shown in the configuration examples of FIG. 6, is an oscillation circuit of Colpitts type and the like in which the oscillation frequency band f thereof is determined by inductance L of the planar inductor 36 and capacitance Co of the concentrated constant capacitor 37, as shown in the following formula (1).

[Formula 1]

$$f = \frac{1}{2\pi\sqrt{LC_0}} \tag{1}$$

A frequency counter 40 is connected to the output terminal of the amplifier 38. A detection signal and the like showing a waveform change part to forecast a polishing end point to be mentioned later herein is output from the frequency counter 40 digitally to the outside. Influences of the noise and the attenuation of the output are prevented by transmitting the detection signal output digitally. Furthermore, the management easiness of film thickness data is obtained.

The polishing end point forecast/detection device 33 is structured to include the high frequency inductor type sensor 34 including the planar inductor 36 and the frequency counter 40. By adjacently arranging the oscillation circuit 35 in the high frequency inductor type sensor 34 and a frequency counter 40 to monitor the change of the oscillation (resonance) frequency thereof, a distributed constant circuit is formed in the wiring/connecting part between the oscillation circuit 35 and the frequency counter 40, inductance and capacitance are prevented from becoming unnecessarily large, and it is possible to precisely detect the change of the magnetic flux with the progress of polishing of the conductive film 28 brought in the vicinity of the high frequency inductor type sensor 34.

In the polishing end point forecast/detection device 33, other components or circuits except the planar inductor 36 are made into an IC (integrated circuit), and contained in a package 33*a*. The planar inductor 36 is coated with a thin insulative film, and fixed onto the surface of the package 33*a*. As shown in the FIGS. 3 and 4, when the packaged polishing end point forecast/detection device 33 is assembled into the chemical mechanical polishing device 1, it is incorporated in so that the planar inductor 36 opposes the conductive film 28 of the wafer W surface.

Furthermore, as for the concentrated constant capacitor 37 constituting the oscillation circuit 35, its capacitance becomes variable, and as for the high frequency inductor type sensor 34, it is possible to choose its oscillation frequency within the oscillation frequency band.

In the present embodiment, the waveform change part to forecast a polishing end point to be mentioned later herein is detected on the basis of a magnetic flux change at the moment when the predetermined conductive film 28 becomes a film thickness corresponding to skin depth δ of the predetermined conductive film 28 in polishing. The skin depth δ in the predetermined conductive film 28 is dependent on the material of the predetermined conductive film 28 and the oscillation frequency f of the high frequency inductor type sensor 34, and is determined as shown in the following formula (2).

[Formula 2]

$$\delta = \sqrt{\frac{2}{\omega\mu\sigma}} \tag{2}$$

Wherein, ω: 2πf, μ: magnetic permeability, σ: conductivity.

The oscillation frequency f of the high frequency inductor type sensor 34 is chosen so that the skin depth δ becomes smaller than the initial film thickness of the predetermined conductive film 28 and becomes larger than the film thickness of the predetermined conductive film 28 of the part except the embedded region in the polishing end stage. In the case where the material of the conductive film 28 of the polishing removal object is Cu, the oscillation frequency band is set 20 MHz or more.

Furthermore, even if a high wave band is selected at frequency, and the inductor is a planar inductor, there are a case when the characteristics of the waveform appear by the skin effect by the distance between the inductor and the conductive film, and the inductor shape, and another case when the characteristics do not appear. For example, the change waveforms of the resonance frequency for the film thickness are different in the same planar inductor when the frequency of 40 MHz is used, and, the size of one inductor is 1/1000 of the inductor of the size of the original, and the distance with the conductive film is 1/1000, and the frequency of same 40 MHz and a planar inductor are used. One has a peak at 0.1 μm or below, but inductor of 1/1000 size, and distance does not have a peak, and increases monotonously to the film thickness. Further, with the inductor of real size, most of magnetic fluxes are in parallel with the conductive film surface and do not penetrate to the film. Under the influence of the skin effect, magnetic flux does not get into a conductive film. In contrast, with the inductor of 1/1000 size and distance, magnetic flux penetrates a conductive film. At this inductor size, the influence of the skin effect does not act. Therefore, as film thickness increases, the eddy current increases monotonously, and accordingly, a mutual inductance (impedance) also increases. Therefore, even if the same frequency and the same planar inductor are used, there are the case where the influence of the skin effect appears, and the case where the same does not appear, by the size and distance. Herein, the state in which there is a state where the influence of such a skin effect appears in a film thickness decrease process by the polishing is created, and, in the state, an end point is forecasted and detected. Furthermore, the film thickness range where the skin effect of this case gives influences does not match the skin depth δ shown in the formula (2) determined simply by the frequency and the material of the conductive film (conductivity and magnetic permeability).

This is because, as shown previously, the skin effect changes by the size and the distance of the inductor, and there is the influence by the direction of the magnetic field (directivity). However, as shown in the formula, when the frequency, conductivity and magnetic permeability become large, the relation itself of the decrease in the distance where a magnetic field can transfer satisfies the relation of the formula, and corresponds thereto. Therefore, film thickness range itself where skin effect appears becomes a value corresponding to the skin depth δ of the expression. Therefore, the characteristic waveform to be based on the skin effect herein is the characteristic waveform change that is obtained by use of the remarkable changes of the states in which the magnetic flux hardly gets into a conductive film under some conditions, and the magnetic flux gets into a conductive film under other conditions, by not only the frequency, the conductivity, the magnetic permeability, but also the directivity of the magnetic field and the like.

Herein, the "film thickness corresponding to the skin depth" and "the magnetic flux change to occur by the skin effect" are explained with reference to FIGS. 7A to 7D. FIG. 7 are figures showing the result of an electromagnetic simulation to find in which directions (arrow→at the bottom of the each FIGS. 7A to 7D) of the magnetic field that occurs from a coil is arranged, and FIG. 7A shows the case where the oscillation frequency from a sensor is 1 MHz and the film thickness of the conductive film is 0.2 μm, FIG. 7B shows the case where the oscillation frequency from a sensor is 1 MHz and the film thickness of the conductive film is 1 μm, FIG. 7C shows the case where the oscillation frequency from a sensor is 40 MHz and the film thickness of the conductive film is 0.2 μm, and FIG. 7D shows the case where the oscillation frequency from a sensor is 40 MHz and the film thickness of the conductive film is 1 μm.

In the setting of the electromagnetic simulation, the inductor that forms a magnetic field is a planar inductor which does not have directivity. The "film thickness corresponding to the skin depth" is "the film thickness that a magnetic flux change produces by the skin effect". In the case when the oscillation frequency of the sensor is 1 MHz, the magnetic flux on the conductive film that is in the bottom of the coil is directed in the lengthwise direction. Even if the film thickness is 1 μm and 0.2 μm at this frequency, the magnetic flux penetrates a conductive film (FIGS. 7A and 7B). In such a case where the magnetic flux penetrates a conductive film, as shown in the conventional example, the eddy current that occurs in the conductive film inside decreases with the film thickness decrease. Therefore, in the case of 1 MHz, the film thickness of 1 μm or below becomes monotonous behaviors, and the skin effect does not appear, and it is thought that "the film thicknesses corresponding to the skin depth" is a film thickness that is at least thicker than 1 μm.

Figures 7A, 7B, 7C, 7D:
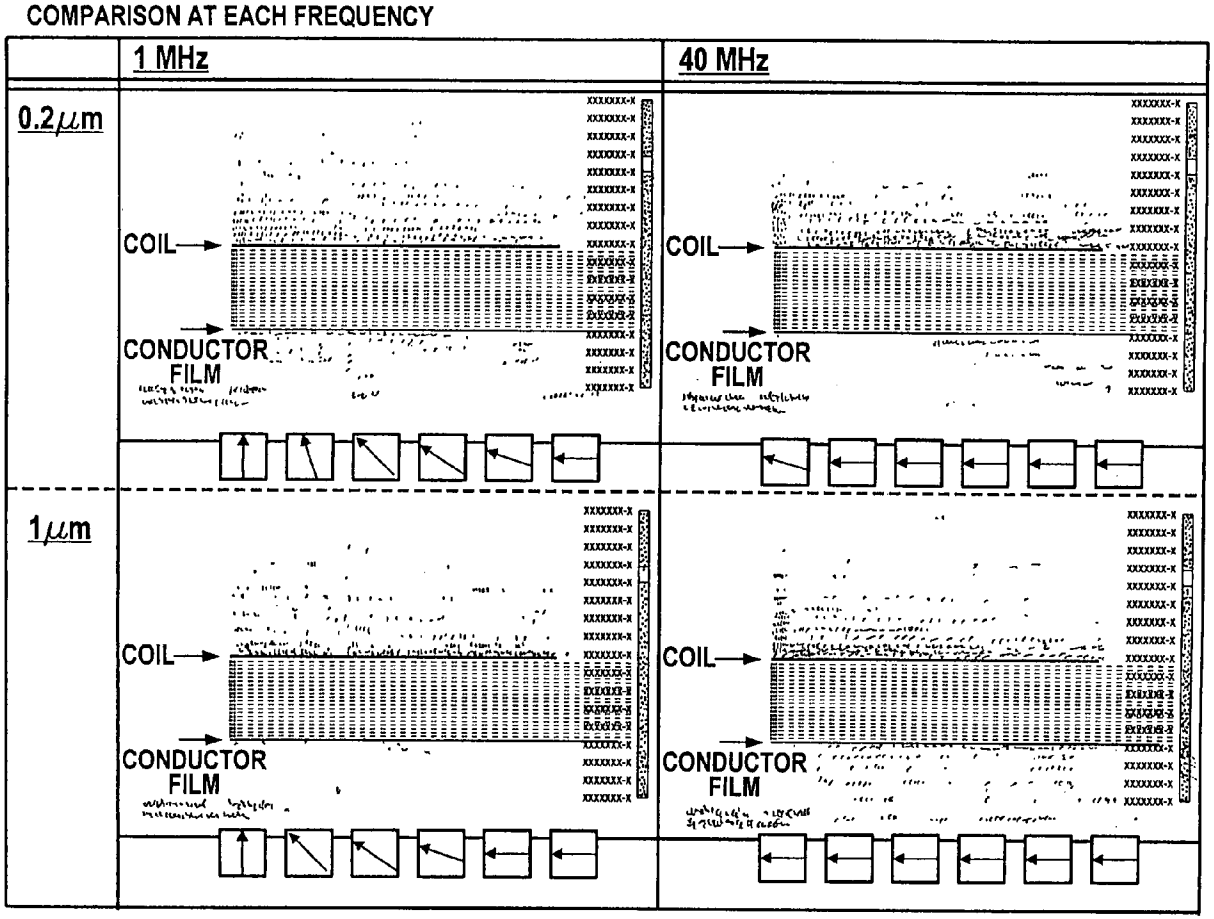
FIG. 7A shows the case where the oscillation frequency from a sensor is 1 MHz and the film thickness of the conductive film is 0.2 μm.
FIG. 7B shows the case where the oscillation frequency from a sensor is 1 MHz and the film thickness of the conductive film is 1 μm.
FIG. 7C shows the case where the oscillation frequency from a sensor is 40 MHz and the film thickness of the conductive film is 0.2 μm.
FIG. 7D shows the case where the oscillation frequency from a sensor is 40 MHz and the film thickness of the conductive film is 1 μm.

In contrast, when the oscillation frequency of the sensor is 40 MHz, the magnetic flux direction at the conductor surface is horizontal obviously, and when the film thickness is 1 μm, it hardly gets into the conductor inside (FIG. 7D). It is clearly understood that in comparison with the former case where the oscillation frequency is 1 MHz and the film thickness is 1 μm (FIG. 7B), the direction of the magnetic flux to get into the conductive film is different.

However, when the oscillation frequency is 40 MHz and the conductive film becomes thin to 0.2 μm (FIG. 7C), only part of the magnetic fluxes are directed in the conductive film inside direction. This shows that some magnetic fluxes penetrate a conductive film when the conductive film becomes certain thinness even when the conductive film is Cu.

In the case of the magnetic flux that alternately changes of 40MH, in accordance with the skin effect, the penetration state of the magnetic flux in the conductive film changes. Under the influence that the penetration magnetic flux increases slowly, the frequency suddenly rises to around 700 Å. Further, when the film thicknesses is 1 μm or more, and the magnetic flux hardly penetrates it. Therefore, in this case, if "the film thickness corresponding to the skin depth" is the film thickness on a boundary whether the magnetic flux penetrates it or not, it is around 1 μm. From this too, when the oscillation frequency is increased to 40 MHz, and a planar inductor is used, the magnetic flux hardly gets into a Cu conductive film of the thickness 1 μm, and this depends on skin effect.

Furthermore, in the case when the oscillation frequency of a Cu conductive film is 40 MHz, if the conductivity of the Cu is 58×106 S/m, the skin depth δ becomes 9.34 μm. For the purpose of calculation, when the film thickness is 1 μm, the magnetic flux gets into a conductive film sufficiently, but a planar inductor is uses, and the magnetic flux does not have directivity, accordingly, the magnetic field actually does not get into a conductive film even when the film thickness is 1 μm by the skin effect in the case when the oscillation frequency is 40 MHz. As the conductive film becomes thin, some magnetic fluxes get into a conductive film, and an eddy current slightly occurs. From this, not measuring the film thickness by use of an eddy current positively, but when the film thickness becomes thin near the end point, by the skin effect, by use of the magnetic flux that slightly leaks and penetrates, it becomes possible to monitor and do not measure a film thickness, the film thickness state of the conductive film in the vicinity of the end point by use of the inflection point (maximum point) of a mutual inductance induced in a conductive film.

Figure 8:
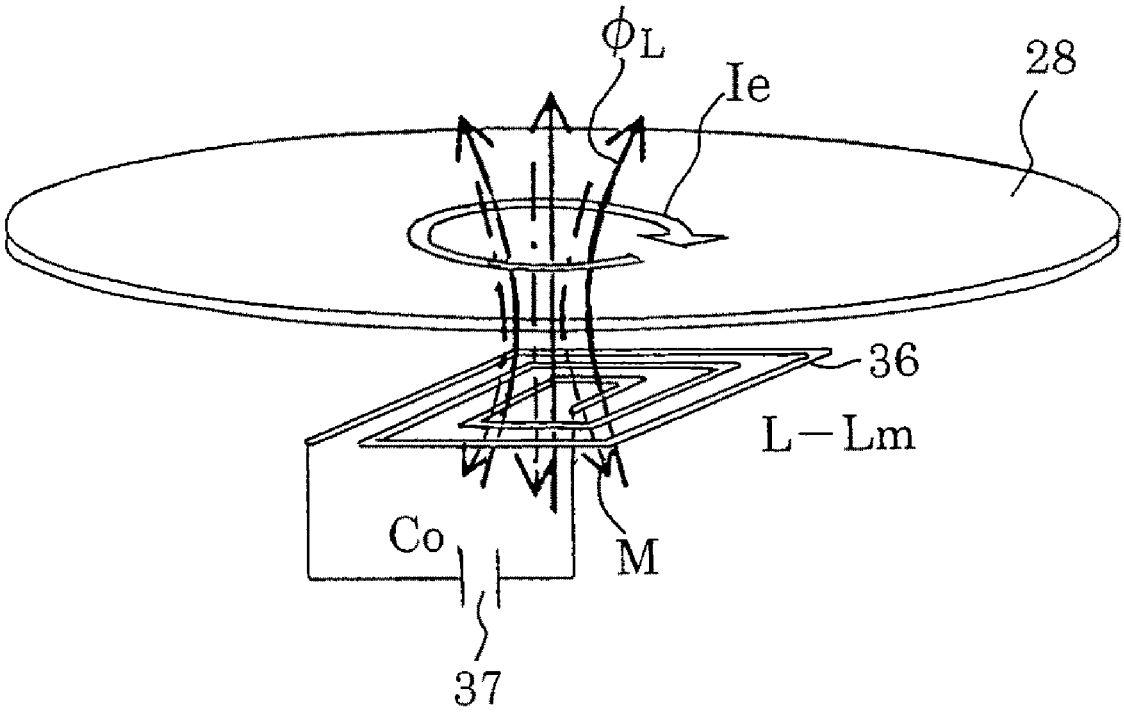
FIG. 8 is a configuration view for explaining the change action of the inductance by the magnetic field that occurs by electromagnetic coupling in the high frequency inductor type sensor according to an embodiment of the present invention.

Next, the polishing action of the chemical mechanical polishing device in which the polishing end point forecast/detection device structured as above is incorporated and a polishing end point forecast/detection method are explained with reference to FIG. 8, FIGS. 9A to 9E and FIGS. 10A to 10E as comparison examples of the FIG. 9. FIG. 8 is a figure for explaining the change action of the inductance by the magnetic field that occurs by electromagnetic coupling in the high frequency inductor type sensor, FIG. 9 is a figure for explaining a change example of the magnetic flux and the eddy current accompanying polishing removal of a conductive film and the detection action of the waveform change part to forecast a polishing end point, and FIGS. 9A to 9D are figures showing change examples of the magnetic flux and the eddy current accompanying polishing removal of a conductive film, and FIG. 9A is a characteristic figure showing a change example of the magnetic flux and the eddy current to the film thickness change of the conductive film. In FIGS. 9A to 9D, for easy recognition of the figures, the planar inductor 36 is displayed in a spiral form.

First, the conductive film 28 waiting in the predetermined point puts the polishing head 3 in chemical mechanical polishing device 1 by the movement mechanism not illustrated on a unpolished wafer W. Then, the vacuum line 24 of the polishing head 3 is operated, and the air chamber 29 of the lower part of the elastic sheet n is made vacuum through a vacuum mouth 19*a* and holes 22 (vacuum holes), and thereby the conductive film 28 absorbs and holds the unpolished wafer W, and, by the movement mechanism, the conductive film 28 carries the polishing head 3 that absorbs and holds the unpolished wafer W to the platen 2, and the wafer W is put on the platen 2 so that the conductive film 28 faces and contacts the polishing pad 6.

When the polishing work of the conductive film 28 of the wafer W upper part is finished, the vacuum line 24 absorbs and holds the wafer W by the polishing head 3 again by the action of the vacuum line 24, and is used when to transport it to a cleaning device not illustrated.

Subsequently, the operation of the vacuum line 24 is released, and air is supplied from a pump not illustrated into the air bag 25 and inflates the air bag 25. At the same time, air is supplied into the air chamber 29 from an air outlet 19 arranged to carrier 8. Thereby, the internal pressure of the air chamber 29 rises.

By inflation of the air bag 25, the conductive film 28 of the wafer W upper part and the retainer ring 9 are pushed to the polishing pad 6 by a predetermined pressure. In this state, the platen 2 is rotated in the arrow A direction of FIG. 1 and the polishing head 3 is rotated in the arrow B direction of FIG. 1, and slurry is supplied from the nozzle not illustrated on the turning polishing pad 6 and the predetermined conductive film 28 of the wafer W upper part is polished.

Then, by the magnetic flux formed of the planar inductor 36 in the high frequency inductor type sensor 34, a film thickness change of predetermined conductive film 28 with the polishing is monitored and a waveform change part to forecast a polishing end point is detected.

The planar inductor 36 is driven by a high frequency oscillated from an oscillation circuit 35, and a magnetic flux ϕ which changes time-serially in correspondence to the period of the high frequency from the planar inductor 36 occurs. The magnetic flux ϕ induced to predetermined conductive film 28 in early stage of polishing passes approximately in parallel with the film surface only in the region of the film thickness corresponding to the skin depth δ, and the invasion of the magnetic flux ϕ to the region beyond the film thickness corresponding to skin depth δ in the predetermined conductive film 28 is evaded (FIG. 9A). Further, the resonance frequency oscillated from the high frequency inductor type sensor 34 is maintained constant, regardless of the film thickness change of the predetermined conductive film 28 (the region a of FIG. 9E).

When the polishing progresses, and the predetermined conductive film 28 becomes same as or near the film thickness corresponding to the skin depth δ, some magnetic fluxes ϕ penetrate the predetermined conductive film 28, and a leakage magnetic flux ϕL begins to appear. The magnetic flux ϕ which does not penetrate the predetermined conductive film 28 passes approximately in parallel with the film surface. And, an eddy current Ie occurs in proportion to the number of the leakage magnetic fluxes ϕL which penetrate in the predetermined conductive film 28 (FIG. 9B).

When the polishing further progresses, the leakage magnetic flux ϕL increases, and the eddy current Ie occurs in the wide region along the film surface of the conductive film 28 (FIG. 9C). The eddy current Ie which occurs in this wide region makes a magnetic field M, as shown in FIG. 8, and acts on so that the magnetic field M offsets the magnetic flux ϕL which occurs from the original planar inductor 36. As a result, by the magnetic field M on which conductive film 28 is formed, a mutual inductance Lm increases, and apparent inductance L of the original planar inductor 36 decreases. As a result, the oscillation frequency f oscillated from the high frequency inductor type sensor 34 increases as shown by the following formula (3).

[Formula 3]

$$f = \frac{1}{2\pi\sqrt{(L - Lm)C_0}} \quad (3)$$

Therefore, by the occurrence of the mutual inductance, the inductance of the sensor circuit system decreases equivalently, and the resonance frequency oscillated from the high frequency inductor type sensor 34 increases (the regions b and c of FIG. 9E).

By further progress of the polishing, the leakage magnetic flux ϕL increases and is saturated. However, the eddy current Ie rapidly decreases with the decrease of the film thickness volume of the predetermined conductive film 28 (FIG. 9D). The mutual inductance decreases rapidly by the rapid decrease of this eddy current Ie. The rapid decrease of this mutual inductance leads to a decline of the decrease of the inductance Lm in the formula (3), and, as a result, the inductance of the sensor circuit system increases equivalently, and the resonance frequency oscillated from the high frequency inductor type sensor 34 declines rapidly (the region d of FIG. 9E).

Thus, after the predetermined conductive film 28 becomes same as or near the film thickness corresponding to the skin depth δ as the polishing progresses, the eddy current Ie occurs, and by the rapid decrease after that, the inductance of the sensor circuit system decreases once, and then increases. By this behavior, a peak (an inflection point) occurs in the waveform of the resonance frequency oscillated from the high frequency inductor type sensor 34. A waveform change part P to forecast the polishing end point before the polishing end point is detected on the basis of this peak, and a polishing end point is forecasted by the change part P. In the case when the predetermined conductive film 28 is Cu, the remaining film amount at the time point when the change part P is detected is approximately 1000 Å, and finish polishing is performed for the remaining film amount, and the polishing is finished.

For the finish polishing, the polishing is finished after, for example, polishing the film thickness corresponding to the skin depth that is the remaining film amount in the waveform change part P for a polishing time set beforehand at a required polishing rate from the waveform change part P. Or, from the time from the early stage of polishing to the detection of the waveform change part P, and the polishing amount before reaching the waveform change part P, the polishing rate in the meantime is calculated, and the film thickness corresponding to the skin depth that is the remaining film amount in the waveform change part P is divided by the polishing rate, and thereby the required polishing time after the detection of the change part P is calculated. And, after the detection of the change part P, polishing is carried out for the calculated polishing time, and the polishing is finished.

Subsequently, the comparison examples of FIGS. 10A to 10E are explained. In the comparison examples, the frequency at which the film thickness corresponding to skin depth δ becomes larger than the initial film thickness of the conductive film 28 is applied. Since such a frequency is applied, during the monitor of the film thickness changes from the early stage of polishing to the end stage of polishing, the magnetic flux ϕ which is induced to the conductive film 28 penetrates the conductive film 28 entirely, and the leakage magnetic flux ϕL occurs consistently. Therefore, during the monitor of the film thickness change, the eddy current Ie in proportion to the number of the leakage magnetic fluxes ϕL occurs (FIGS. 10A to 10D). Therefore, a large mutual inductance occurs between the conductive film 28 and the planar inductor by this eddy current Ie, and the oscillation frequency f oscillated from the sensor by the decreased portions Lm of the inductance by this mutual inductance becomes as shown in the formula (3) from the early stage of polishing.

Then, the eddy current Ie suddenly decreases according to the decrease of the film thickness by the progress of polishing (FIGS. 10B to 10D), and the mutual inductance decreases with this, and the decreased portions Lm of inductance in the formula (3) decreases too. As a result, the inductance of sensor circuit system increases equivalently, and the resonance frequency oscillated by the sensor decreases monotonously (FIG. 10E).

Thus, in the comparison example, the resonance frequency draws a monotonous decrease curve, therefore it is possible to estimate the film thickness decrease amount from the early stage of polishing, but it is not possible to exactly distinguish the polishing end point or the state before the polishing end point. For example, when the floating capacity C is changed by a delicate setting, the overall resonance frequency in FIG. 10E shifts up and down over the whole waveform. Therefore, even if a polishing end point is set to the moment when the frequency of temporary setting, it is not possible to set the threshold value if the resonance frequency shifts overall. Furthermore, even if the state of the quantity of removal from the initial film thickness is monitored by the eddy current change in real-time, when the initial film thickness fluctuates, the film thickness that becomes the polishing end point also fluctuates. Because there is not the characteristic of the waveform, the threshold value cannot be also set in this case in the same manner as the above.

Figure 11B:
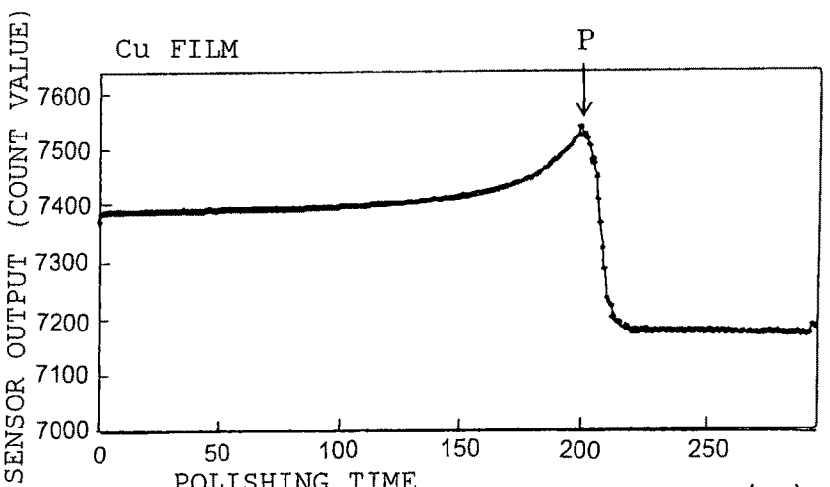
FIG. 11B is a figure showing a change characteristic example of the resonance frequency to the film thickness of the Cu film.
Figure 11A:
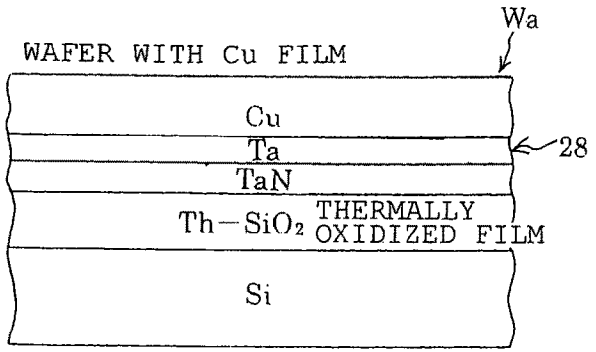
FIG. 11A is a figure showing a wafer Wa with a Cu film.
Figure 11D:
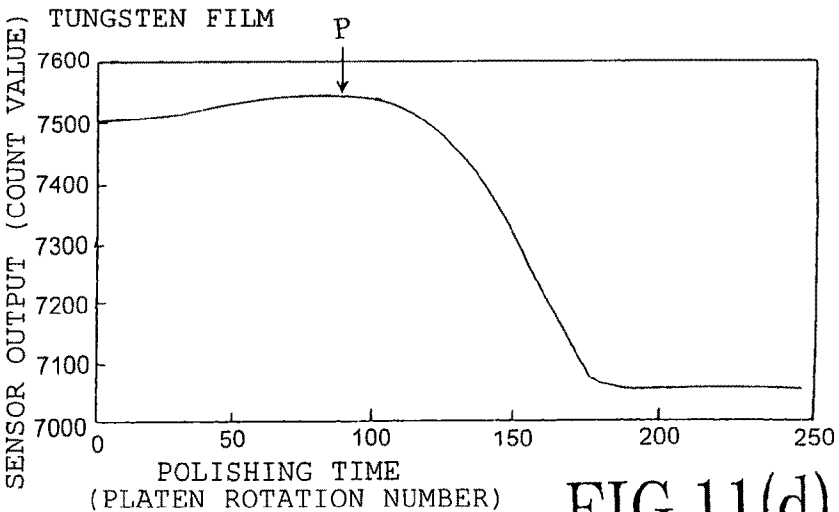
FIG. 11D is a figure showing a change characteristic of the resonance frequency to the film thickness of the tungsten (W) film.
Figure 11C:
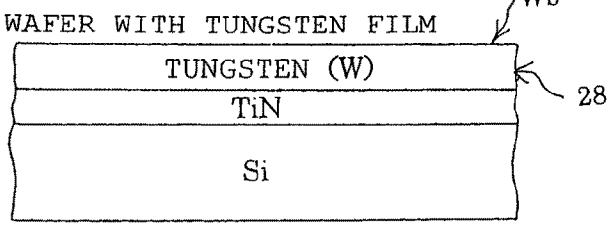
FIG. 11C is a figure showing a wafer Wb with a tungsten (W) film.

FIGS. 11A to 11D show the results of the evaluation on the peak to become the waveform change part P, about two kinds of wafers Wa and Wb, in which the materials and the conductivity of conductive films to become the polishing targets are different. FIG. 11A is a figure showing a wafer Wa with a Cu film, FIG. 11B is a figure showing a change characteristic of the resonance frequency to the film thickness of the Cu film, FIG. 11C is a figure showing a wafer Wb with a tungsten (W) film, and FIG. 11D is a figure showing a change characteristic of the resonance frequency to the film thickness of the tungsten (W) film. The sensor output of each ordinate axis in FIGS. 11B and 11D corresponds to the resonance frequency.

In both of the Cu film and the tungsten (W) film, the resonance frequency increases with progress of the polishing once, and suddenly decreases, and a peak (an inflection point) occurs afterwards. The waveform change part P is detected each on the basis of this peak (an inflection point). This behavior is conspicuous in the Cu film of the large conductivity shown in FIG. 11B more clearly than the case of the tungsten (W) film shown in FIG. 11D.

Figure 12A:
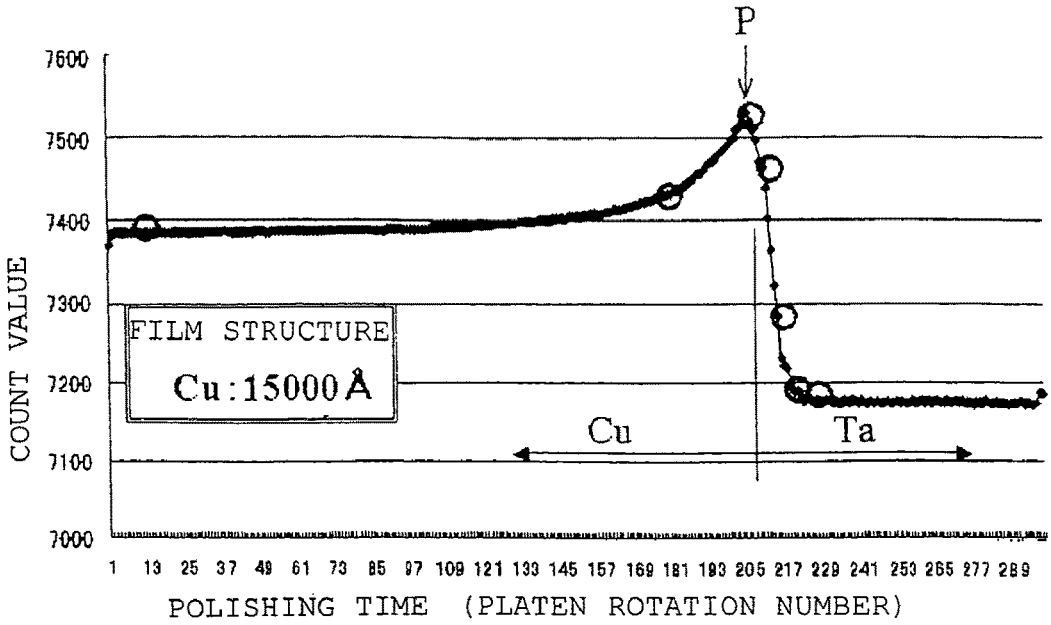
FIG. 12A is a figure showing the relation between the film thickness and the resonance frequency with the progress of polishing.
Figure 12B:
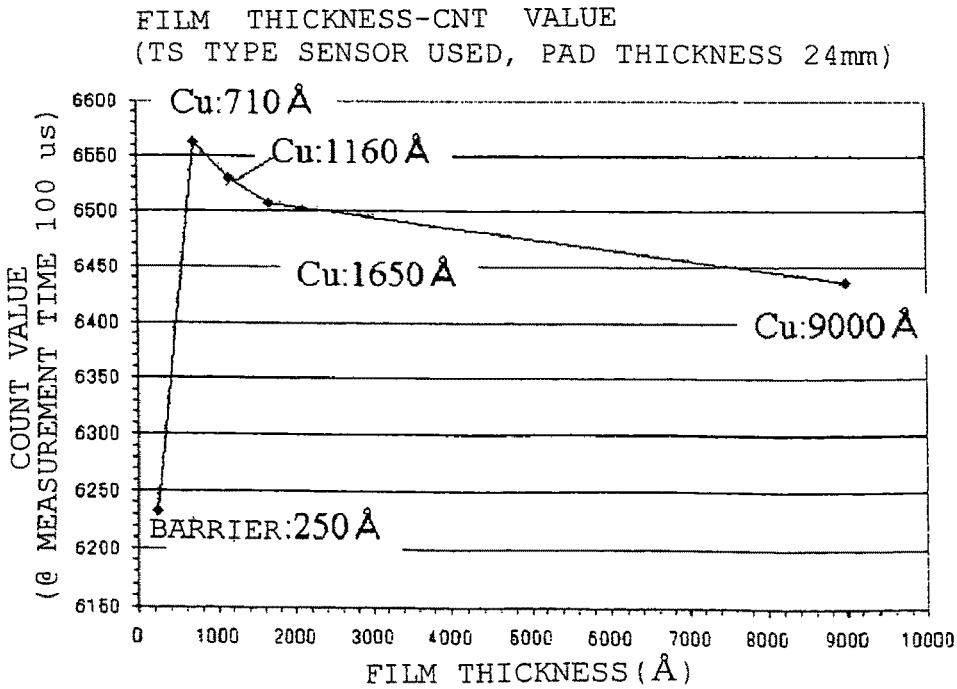
FIG. 12B is a figure showing the relation between the film thickness and the resonance frequency in resting state.

FIGS. 12A and 12B are figures showing the relation between the film thickness and the resonance frequency in the case where the conductive film of the polishing target is a Cu film, and FIG. 12A is a figure showing the relation between the film thickness and the resonance frequency with the progress of polishing, and FIG. 12B is a figure showing the relation between the film thickness and the resonance frequency in resting state. The count value of each ordinate axis in FIGS. 12A and 12B corresponds to the resonance frequency.

In FIG. 12A, the initial film thickness of the Cu film is approximately 1.5 μm (15000 Å). As for the Cu film, the resonance frequency increases slowly with progress of the polishing from the point where the film thickness is approximately 1 μm (10000 Å), and reaches the maximum value in the vicinity of 700 Å, and the waveform change part P is detected. The resonance frequency suddenly declines after it reaches the maximum value. Thus, in the Cu film, the remaining film thickness at the moment when the waveform change part P is detected is precisely detected.

In FIG. 12B, the resonance frequency measured for each film thickness of the Cu film in resting state shows the maximum value when the film thickness is around 710 Å. Therefore, the film thickness of the Cu film at which the resonance frequency becomes at maximum in resting state, and the film thickness of the Cu film at which the resonance frequency becomes at maximum during progress of the polishing are almost same.

Next, a method to forecast a polishing end point with the peak of the resonance frequency during a magnetic flux change process as a film thickness reference point is explained further.

Figure 13:
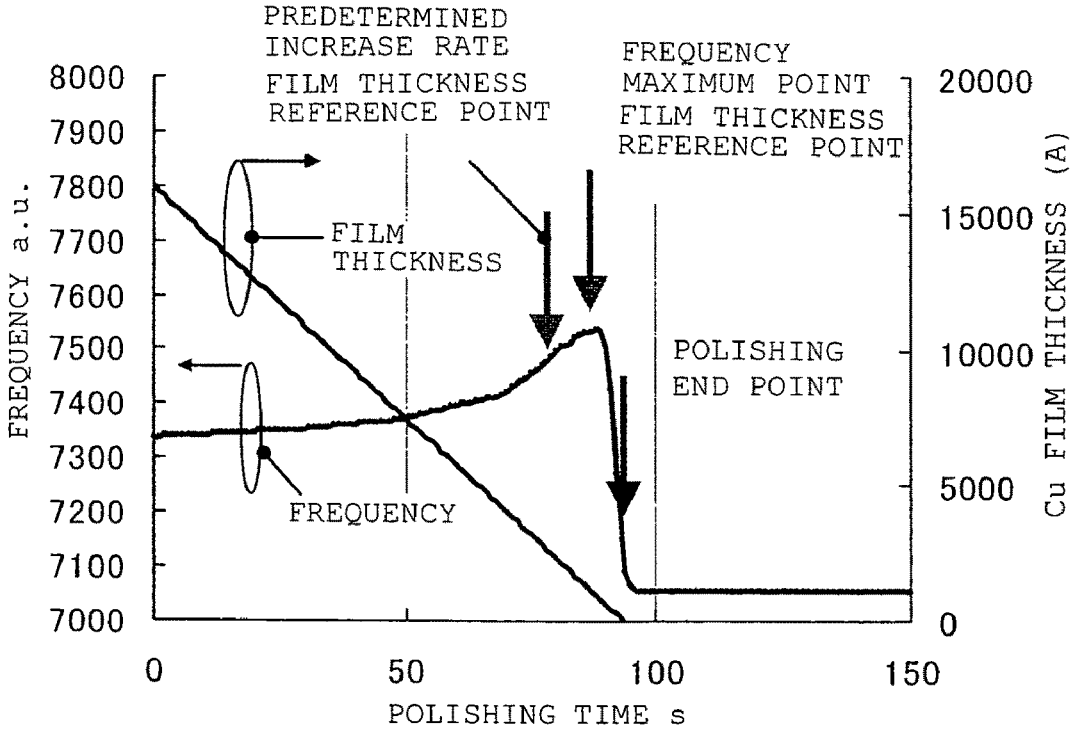
FIG. 13 is a figure showing the relation between the film thickness and the resonance frequency according to an embodiment of the present invention.

First, FIG. 13 is a figure showing the relation between the film thickness and the resonance frequency, in correspondence to the film thickness. As the forecast/detection method of the most standard polishing end point, it is the case where in the resonance frequency waveform of FIG. 13, a part equivalent to the peak of the waveform is specified as a film thickness standard value, and on the basis of the film thickness standard value, and a polishing end point is calculated. The polishing end point defines the moment when a film of the Cu is removed, namely, the time when the Cu film becomes 0 Å as an end point.

As shown in FIG. 13, the film thickness standard value equivalent to the peak of the waveform corresponds to 710 Å. In the same figure, the waveform of the resonance frequency is monitored, and the time point when the waveform reaches its peak point in time is detected. For the detection method of the peak, the waveform always increases with the decrease of the film thickness once, and then decreases rapidly, therefore, the peak point may be judged at the time point when the resonance frequency decreases before the point. Further, as another method, differential coefficient is always obtained, and the part where the differential coefficient becomes 0 or below or negative may be made a peak position.

In a case of FIG. 13, as an initial film, a blanket film having a Cu film of 16000 Å is prepared herein, and the polishing accident of the time point when the Cu film is removed is forecasted, and an end point is detected. In FIG. 13, at the time point of 89 s after polishing start, it arrives at the film thickness reference point of remaining 780 Å. In other words, the removal quantity from the early stage is 16000 Å−780 Å=15220 Å. If the removal quantity is 15290 Å after the lapse of 89 s, the time necessary to remove the remaining 780 Å is approximately 4.43 s. In other words, if the polishing is stopped after approximately 4.5 s after the film thickness reference point detection, the Cu film thickness is almost 0 Å, and it is possible to precisely stop the polishing at a polishing end point. Herein, naturally, it is premised that removal is carried out at a constant polishing rate during polishing.

Figure 14:
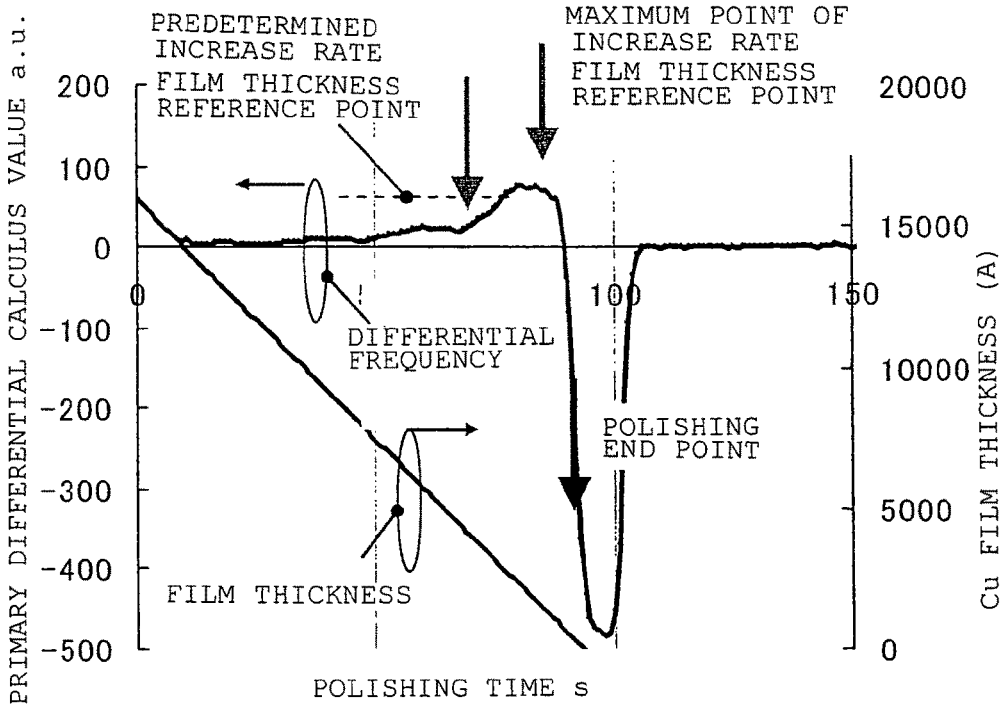
FIG. 14 is a figure showing the correspondence between a film thickness change and the primary differential calculus value of the resonance frequency according to an embodiment of the present invention.

Furthermore, as another method, detection may be possible not depending upon the peak position of the resonance frequency, but even before that. For example, in the present invention, the waveform of the resonance frequency passes through the process that it suddenly increases before leading to the peak point of resonance frequency. This rate of climb is set beforehand and, at a time point of the rate of climb, a polishing end point may be forecasted. Or, a time point when the rate of climb becomes at maximum may be monitored beforehand, and the time point when the rate of climb becomes at maximum is defined as a film thickness reference point, and setting may be made from the point. In the case when an end point is detected by the rate of climb, as shown in FIG. 14, it is effective to show the waveform in which the waveform of the resonance frequency is differentiated at any time in this manner. In the case when forecast the same at the time point when it becomes the predetermined rate of climb, a threshold value is set to a differentiated graph, and on the basis of the polishing time reaching the threshold value, the necessary polishing time to the end time point may be calculated back in the same manner as the above.

Herein, as an example, a method to forecast a polishing end point in which the time point when the rate of climb becomes at maximum is defined as a film thickness reference point, and a polishing end point is forecasted from the time point is shown. In FIG. 14, it is shown that the largest rate of climb is obtained at the time point of 81 s. The remaining film thickness is equivalent to 2149 Å then. Therefore, if 13851 Å is polished after the lapse of 81 s, and the time necessary to polish around remaining 2149 Å is 12.56 s. Therefore, when the polishing is ended after 12.5 seconds, the Cu film thickness becomes approximately 0 Å, and it is possible to precisely stop the polishing at the polishing end point.

Figure 15:
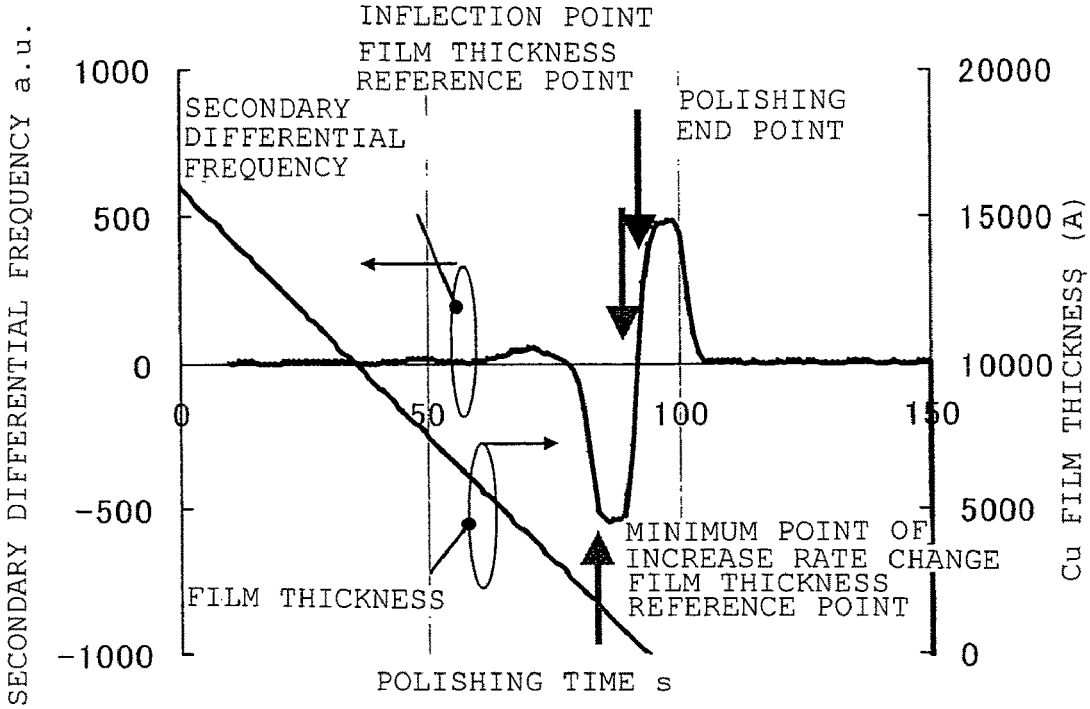
FIG. 15 is a figure showing the correspondence between a film thickness change and the secondary differential calculus value of the resonance frequency according to an embodiment of the present invention.

It becomes possible to forecast an end time point of the polishing in various parts in the manners mentioned above, and for example, in the case when the graph which is differentiated twice as shown in FIG. 15 is shown, the inflection point of the resonance frequency, namely, the point that becomes 0 in the graph which is differentiated twice in FIG. 15 is defined as a film thickness standard value and an polishing end point may be forecasted. Further, with the part at which the change degree of the rate of climb of the resonance frequency becomes the predetermined value as a standard, and with the point as a film thickness reference point, the polishing time to the polishing end may be estimated.

As shown above, in the case to obtain a waveform of the skin effect characteristic to take the behavior where the resonance frequency increases with the film thickness decrease by the polishing once, and suddenly declines afterwards, it is possible to monitor various characteristic changes at the time point before the polishing end, and on the basis of the changes, it is possible to precisely estimate the polishing time to a polishing end point. This is to forecast a polishing end point substantially, but, in the case to forecast the moment just before a polishing end point, it has almost same meaning as roughly detecting a polishing end point.

Meanwhile, as for the present embodiment, it is possible to detect the waveform change part P on the basis of at least any one of changes of the mutual inductance, the eddy current Ie, the leakage magnetic flux $\phi L$ other than the change of the resonance frequency. The change of the mutual inductance may be obtained from a change of the oscillation frequency of the high frequency inductor type sensor 34 by use of the formula (3), and since the eddy current Ie is in a proportion relation with the mutual inductance, the change of eddy current Ie may be obtained by use of the change of the mutual inductance, and since the leakage magnetic flux $\phi L$ is in a proportion relation with the eddy current Ie, the change of the leakage magnetic flux $\phi L$ may be obtained by use of the change of the eddy current Ie.

As mentioned above, in the polishing end point forecast/detection method and the device thereof according to the present embodiment, since the leakage magnetic flux $\phi L$ to become the base of the waveform change part P detection occurs when the predetermined conductive film 28 becomes the film thickness just before the polishing end point same as or near the skin depth by progress of the polishing, it is possible to suppress the Joule heat loss by the eddy current Ie occurring in the leakage magnetic flux $\phi L$ to the minimum.

Since a conspicuous peak occurs during the respective changes of the eddy current Ie, the mutual inductance and the resonance frequency, after the predetermined conductive film 28 becomes a film thickness corresponding to the film thickness same as or near the skin depth $\delta$, by progress of the polishing, on the basis of this conspicuous peak, it is possible to precisely detect the waveform change part P just before the polishing end point. Therefore, it is possible to precisely forecast/detect a polishing end point from the waveform change part P.

By making the transmission method of the resonance frequency from the high frequency inductor type sensor 34 as the digital output by use of the frequency counter 40, it is possible to prevent the influences of noises and the attenuation of the resonance frequency output, and precisely detect the waveform change part P.

By making the concentrated constant capacitor 37 constituting the high frequency inductor type sensor 34 as capacitance variable, it is possible to easily choose an oscillation frequency so that the film thickness corresponding to the skin depth $\delta$ becomes appropriate to the conductive film 28 of the different film kinds.

Since the planar inductor 36 which is the main component of the high frequency inductor type sensor 34 has little occurrence of noise and electricity consumption, and further, since it is comparatively low cost, it is possible to attain a cost reduction.

Second Embodiment

Hereinafter, a real-time film thickness monitoring method and a device thereof according to a second embodiment of the present invention are explained. In the present embodiment, the polishing end point forecast/detection device 33 shown in the FIGS. 5A, 5B, and 5C functions as a real-time film thickness monitoring device. And the real-time film thickness monitoring device 33 is incorporated in the platen 2 or the polishing head 3 as shown in the FIG. 3 and FIG. 4.

The real-time film thickness monitoring method by the real-time film thickness monitoring device 33 is explained. In the same manner as in the first embodiment, the waveform change part P just before a polishing end point shown in FIG. 9E is detected. The waveform change part P output from the frequency counter 40 is input into a CPU not illustrated and the like, and on the basis of the change part P, respective polishing data such as the polishing rate and the like are calculated from the remaining film amount to be removed almost same as the film thickness corresponding to the skin depth $\delta$, and the quantity of the already removed film thickness and the time required therefor are calculated on the spot, and it is evaluated whether the predetermined conductive film 28 is appropriately removed in real-time.

As mentioned above, according to real-time film thickness monitoring method and the device thereof according to the present embodiment, it is possible to precisely calculate the remaining film amount to be removed and the respective polishing data such as the polishing rate and the like, on the basis of the waveform change part P, after the detection of the waveform change part P to forecast a polishing end point just before the polishing end point, and thereby it is possible to evaluate whether the predetermined conductive film 28 is appropriately removed. Moreover, it is possible to suppress the Joule heat loss by the eddy current Ie occurring in the leakage magnetic flux $\phi L$ to the minimum.

The present invention can be variously modified without deviating from the spirit and scope of the present invention, and it is only natural that the present invention extends over the modifications thus carried out.

What is claimed is:

1. A polishing end point forecast/detection method for forecasting/detecting a polishing end point at the moment when a conductive film is polished and a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film, and there is at least once of the process in which at least the part of the magnetic flux to penetrate the predetermined conductive film increases with the progress of polishing, and the change of the leakage magnetic flux to penetrate the predetermined conductive film during progress of the polishing among magnetic flux formed of the inductor is monitored, and by use of the change of the leakage magnetic flux in which a film thickness in polishing conspicuously appears by the skin effect, a leakage magnetic flux change part to forecast a polishing end point in the leakage magnetic flux change process is detected, and thereby a polishing end point is forecasted by the leakage magnetic flux change part.

2. The polishing end point forecast/detection method for forecasting/detecting a polishing end point according to claim 1, wherein in a method to forecast a polishing end point from a waveform change part by the skin effect, after polishing for a polishing time set beforehand from the waveform change part, the polishing is ended.

3. The polishing end point forecast/detection method for forecasting/detecting a polishing end point according to claim 1 wherein in a method to forecast and detect from a waveform change part by the skin effect, from the time from the early polishing stage to the waveform charge part, and the quantity of polishing from the early polishing stage to the waveform change part, the polishing rate is calculated, and the film thickness calculated by the waveform change part is divided by the polishing rate, and thereby the remaining polishing time required from the waveform change part to polishing end point is calculated, and after polishing is carried out for the calculated time from the waveform change part, the polishing is ended.

4. A polishing end point forecast/detection method for forecasting/detecting a polishing end point at the moment when a conductive film is polished and a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the conductive film by an inductor shape to generate a magnetic field without directivity of the degree that does not penetrate the predetermined conductive film by the skin effect of the predetermined conductive film and the skin effect, and there is at least once of the process in which at least the part of magnetic flux to penetrate the predetermined conductive film increases with the progress of polishing, and the change of leakage magnetic to penetrate the predetermined conductive film during the progress of polishing among magnetic flux formed of the inductor is monitored as the change of a eddy current generated by the leakage magnetic flux, a change part of an eddy current to forecast a polishing end point in the eddy current change process in which the film thickness in polishing conspicuously appears by the skin effect is detected, and a polishing end point is forecasted from the change part of the eddy current.

5. The polishing end point forecast/detection method for forecasting/detecting a polishing end point according to claim 4, wherein the waveform change part is the changes peculiar to the skin effect of the top of the peak, an inflection point, the rate of climb of the change, quantity of rise change, and the rise starting point.

6. A polishing end point forecast/detection method for precisely forecasting/detecting a polishing end point at the moment when a conductive film is polished and a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by an inductor shape to generate a magnetic field without directivity of the degree that does not penetrate the predetermined conductive film by the skin effect of the predetermined conductive film and the skin effect, and there is at least once of the process in which at least the part of magnetic flux to penetrate the predetermined conductive film increases with the progress of polishing, and the change of eddy current occurred by the change of the leakage magnetic flux to penetrate the predetermined conductive film during progress of the polishing among magnetic flux formed of the inductor is monitored as the change of a mutual inductance that occurs in the inductor by the eddy current, and a mutual inductance change part to forecast the polishing end point is detected on the basis of the case when the film thickness in polishing becomes same as or close to the skin depth with the skin effect, and the polishing end point is forecasted from the change part.

7. A polishing end point forecast/detection method for forecasting/detecting a polishing end point at the moment when a conductive film is polished and a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by an inductor shape to generate a magnetic field without directivity of the degree that does not penetrate the predetermined conductive film by the skin effect of the predetermined conductive film and the skin effect, and there is at least once of the process in which at least the part of magnetic flux to penetrate the predetermined conductive film increases with the progress of polishing, and the change of the inductance of a sensor circuit system in the high frequency inductor type sensor based on the change of the leakage magnetic flux to penetrate the predetermined conductive film during progress of the polishing among magnetic flux formed of the inductor is monitored as the change of the resonance frequency to be determined by the inductance and the intrinsic capacity of the sensor circuit system, and a mutual inductance change part to forecast the polishing end point is detected on the basis of the change of the resonance frequency in the case when the film thickness in polishing becomes corresponding to the film thickness with the skin effect, and the polishing end point is forecasted from the resonance frequency change part.

8. The polishing end point forecast/detection method according to claim 7, wherein during each change of the eddy current, the mutual inductance or the resonance frequency when the film thickness of the predetermined conductive film in polishing becomes that corresponding to the skin depth, the maximum point (peak) occurs by operating two phenomena of the increase of the eddy current by the increase in the leakage magnetic flux to produce at a film thickness corresponding to the skin depth and the decrease of the eddy current formation region with the decrease of the film thickness volume by the polishing, and the change part is detected on the basis of the maximum point (peak).

9. A polishing end point forecast/detection method for forecasting/detecting a polishing end point at the moment when a conductive film is polished and a predetermined conductive film is appropriately removed, wherein an inductor in the high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by an inductor shape to generate a magnetic field without directivity of the degree that does not penetrate the predetermined conductive film by the skin effect of the predetermined conductive film and the skin effect, and there is at least once of the process in which at least the part of magnetic flux to penetrate the predetermined conductive film increases with the progress of polishing, and at least any one of the change of eddy current that occurs by the change of the leakage magnetic flux penetrating the predetermined conductive film during progress of the polishing among magnetic flux formed of the inductor, the change of a mutual inductance occurring to the inductor by the change of the eddy current, and the change of resonance frequency oscillated from the high frequency inductor type sensor by the change of the inductance of a sensor circuit system in the high frequency inductor type sensor based on the change of the mutual inductance is monitored, and a resonance frequency change part to forecast the polishing end point is detected on the basis of at least any one of the changes in the case when the film thickness in polishing becomes corresponding to the film thickness with the skin effect, and the polishing end point is forecasted from the change part.

10. A real-time film thickness monitoring method of monitoring a film thickness change during polishing for evaluating whether a conductive film is polished and a predetermined conductive film is appropriately removed, wherein an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of magnetic flux to penetrate the predetermined conductive film increases with the progress of polishing, and the change of the leakage magnetic flux to penetrate the predetermined conductive film during progress of the polishing among magnetic flux formed of the inductor is monitored, and a leakage magnetic flux change part to forecast an polishing end point from the change of the leakage magnetic flux at the moment when the film thickness in polishing becomes a film thickness corresponding to the skin effect is detected, and a polishing rate and a remaining film thickness amount to be removed are calculated on the basis of the change part on the spot.

11. A real-time film thickness monitoring method of monitoring a film thickness change during polishing for evaluating whether a conductive film is polished and a predetermined conductive film is removed appropriately, wherein an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of the magnetic flux to penetrate the predetermined conductive film increases with the progress of polishing, and the change of the leakage magnetic flux to penetrate the predetermined conductive film during progress of the polishing among magnetic flux formed of the inductor is monitored as the change of an eddy current that the leakage magnetic flux produces, and a leakage magnetic flux change part to forecast an polishing end point from the change of the leakage magnetic flux at the moment when the film thickness in polishing becomes a film thickness corresponding to the skin effect is detected, and a polishing rate and a remaining film thickness amount to be removed are calculated on the basis of the change part on the spot.

12. A real-time film thickness monitoring method of monitoring a film thickness change during polishing for evaluating whether a conductive film is polished and a predetermined conductive film is appropriately removed, wherein an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of magnetic flux to penetrate the predetermined conductive film increases with the progress of polishing, and the change of the eddy current occurring by the leakage magnetic flux to penetrate the predetermined conductive film during progress of the polishing among magnetic flux formed of the inductor is monitored as the change of a mutual inductance occurring in the inductor by the eddy current, and a mutual inductance change part to forecast a polishing end point at the moment when the film thickness in polishing becomes a film thickness corresponding to the skin effect is detected, and a polishing rate and a remaining film thickness amount to be removed are calculated on the basis of the change part on the spot.

13. The real-time film thickness monitoring method according to claim 10, 11 or 12, wherein during each change of the eddy current, the mutual inductance or the resonance frequency when the film thickness of the predetermined conductive film in polishing becomes same as or close to the skin depth, a peak occurs by operating two phenomena of the increase of the eddy, current by the increase in the leakage magnetic flux by the skin effect and the decrease of the eddy current with the decrease of the film thickness volume by the polishing, and the change part to forecast a polishing end point is detected on the basis of the peak.

14. A real-time film thickness monitoring method for monitoring a film thickness change during polishing for evaluating whether a conductive film is polished and a predetermined conductive film is appropriately removed, wherein an inductor in a high frequency inductor type sensor is arranged adjacent to the predetermined conductive film, and at least part of the magnetic flux formed of the inductor in the early polishing stage makes the high frequency inductor type sensor oscillate the frequency that does not penetrate the predetermined conductive film by a skin effect of the predetermined conductive film, and there is at least once of the process in which at least the part of the magnetic flux to penetrate the predetermined conductive film increases with the progress of polishing, and the change of the inductance of a sensor circuit system in the high frequency inductor type sensor based on the change of the leakage magnetic flux to penetrate the predetermined conductive film during progress of the polishing among magnetic flux formed of the inductor is monitored as the change of the resonance frequency to be determined by the inductance and the intrinsic capacity of the sensor circuit system, and a resonance frequency change part to forecast the polishing end point is detected from the resonance frequency change in the case when the film thickness in polishing becomes corresponding to the skin depth, and a polishing rate and a remaining film thickness amount to be removed are calculated on the basis of the change part on the spot.

* * * * *